US006029334A

United States Patent [19]

Hartley

[11] Patent Number: 6,029,334

[45] Date of Patent: Feb. 29, 2000

[54] HEMMING METHOD AND APPARATUS

[75] Inventor: William R. Hartley, Macomb, Mich.

[73] Assignee: UNOVA IP Corp., Beverly Hills, Calif.

[21] Appl. No.: 08/982,676

[22] Filed: Dec. 2, 1997

[51] Int. Cl.[7] ..... B23Q 3/00

[52] U.S. Cl. ..... 29/464; 29/509; 29/521; 29/469; 72/403

[58] Field of Search ..... 29/469, 464, 509, 29/521, 522.1; 72/323, 306, 403, 397

[56] References Cited

U.S. PATENT DOCUMENTS

| | | | |
|---|---|---|---|
| Re. 31,535 | 3/1984 | Schleicher | 29/521 |
| 3,909,919 | 10/1975 | Miyabayashi et al. | 29/509 |
| 4,803,767 | 2/1989 | Obrecht et al. | 29/509 |
| 5,237,734 | 8/1993 | Polon | 29/513 |
| 5,272,903 | 12/1993 | Evans | 72/403 |
| 5,357,665 | 10/1994 | Fukui et al. | 29/243.58 |
| 5,457,981 | 10/1995 | Brown et al. | 72/451 |
| 5,487,219 | 1/1996 | Ruehl et al. | 29/521 |
| 5,490,310 | 2/1996 | Schleicher | 29/521 |
| 5,507,165 | 4/1996 | Hartley | 72/311 |
| 5,642,641 | 7/1997 | Maxfield, Jr. et al. | 403/14 |

*Primary Examiner*—David P. Bryant
*Assistant Examiner*—Jermie E. Cozart
*Attorney, Agent, or Firm*—Reising, Ethington, Barnes, Kisselle, Learman & McCulloch, P.C.

[57] ABSTRACT

Improved method and apparatus for interlocking hemmed together edges of inner and outer vehicle body panels with an improved interlock joint. The inner panel blank is draw stamped and provided with PLP holes in a stamping press. A plurality of conventional hardware components are then welded to the inner panel. Then interlock holes are formed by a piercing tool moving through the inner panel border from its outboard to its inboard side while the inner panel is held by clamps and PLP pins. The hole piercing punch thus leaves cold worked upset material slightly raised inboard, rather than outboard, around the pierced interlock hole margin. Then the inner panel subassembly is married to the outer panel and transferred to a hemming station and again precisely clamped and positioned by PLP pins, whereupon hemming press gates are operable for hemming the flange lip of the outer panel over the inner panel border. The final hemming steel of each gate carries staking punches that individually strike a precision registered portion of such hemmed lip to deform it into locking engagement with the associated interlock hole. The upset material is thus flattened and accurately worked into embedment into the interior surface of the hemmed flange lip, rather than into the interior surface of the outer panel, thereby avoiding creating read through problems on the outer panel.

15 Claims, 11 Drawing Sheets

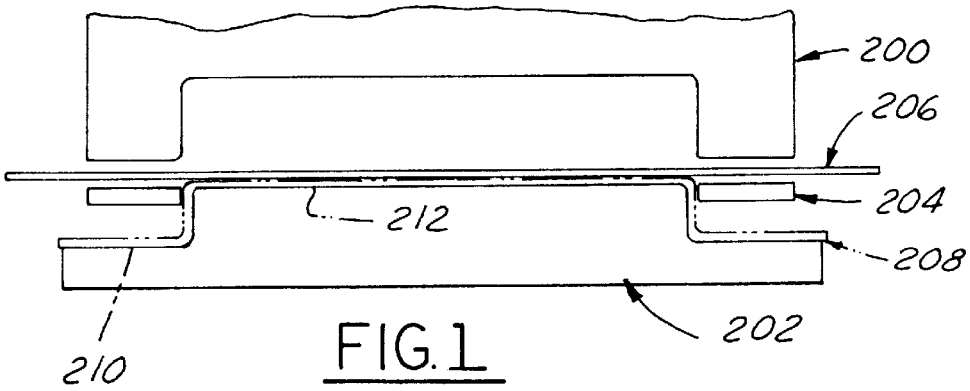
FIG. 1
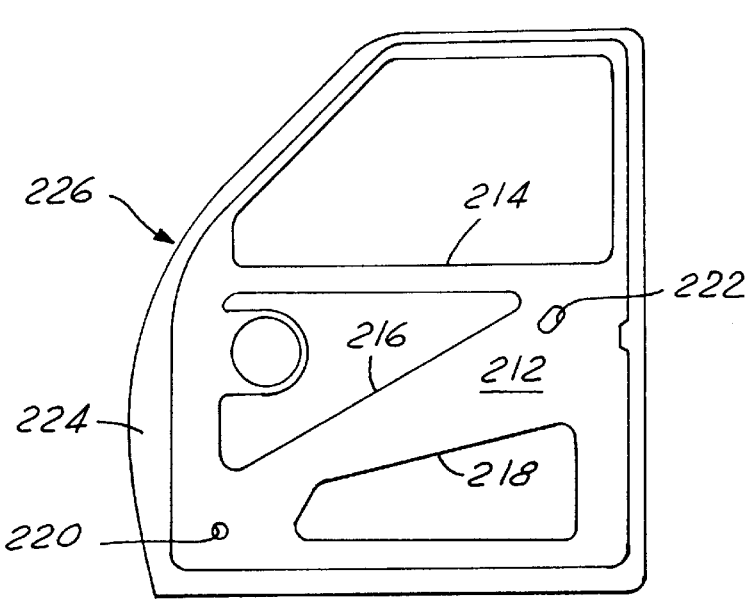
FIG. 2
INNER PANEL MOVE TO TRIM AND PUNCH P.L.P.
PRE-ASSEMBLY PROCEDURE AND WELDING OF ALL HARDWARE
FIG. 3A

HEMMING METHOD AND APPARATUS

FIELD OF THE INVENTION

This invention relates to hemming of sheet metal, and more particularly to a method and apparatus for forming a hem on an edge flange of a sheet of a multi-ply structural sheet member, such as a vehicle body panel.

BACKGROUND OF THE INVENTION

It is well known to construct motor vehicle body doors, hoods, fenders, tailgates, trunk and deck lids by stamping an outer sheet metal panel and separately stamping an inner sheet metal reinforcing panel with an outer periphery generally matching that of the outer panel, and then joining the two panels together by hemming a flange-over, the periphery of the outer panel over an adjacent edge of the inner panel to thereby secure the panels together. The inner and outer panels are individually stamped to their desired size and shape, with the outer panel being slightly larger than the inner panel to provide a border flange portion along the edge of the outer panel having an upstanding lip which can be folded over the peripheral edge of the inner panel to define the hem flange which connects the two panels.

It has been recognized in the prior art that this hem flanging together of the panels may not be sufficient to prevent the inner panel from sliding relative to the outer panel. Accordingly, it has been known to employ auxiliary attachment techniques to lock the panels against relative movement. For example, it has been known to apply an arc, mig, or fusion weld to tack the hemmed-over edge of the outer panel to the inner panel. It is also known to spot weld the two panels together at the flange. In still other situations, induction heat has been used to cure an adhesive previously applied between the panels at the area of the flange. In each of these cases, the operation require additional equipment and inevitably damages or distorts the assembled panels, which in turn requires refinishing of the metal to correct the imperfections which will become visible i.e., "read through", when the outer panel is painted.

It has also been known to punch holes in the edge of the inner panel during the progressive die stamping operations typically employed in making the inner panel. Then in the downstream hemming station corresponding projections are provided on the face of the hem flanging punch so that the punch which flanges the outer panel over the inner panel will also press and coin the flange into the holes in the inner panel. Although this mechanical coined interlock technique eliminates the additional investment and labor of a welding operation, it nonetheless has been found to distort the outer panel because the punching burrs or upset edge on the inner panel outboard side around each punched hole in the inner panel causes read through on the exterior or outboard surface of the outer panel.

Another prior approach to overcoming the problems of interlocking the hemmed together flanges of the inner and outer panels is that disclosed in U.S. Pat. No. 5,237,734, issued Aug. 24, 1993, the disclosure of which is incorporated herein by reference. In the '734 patent a plurality of raised beads are formed at spaced intervals along the length of the edge of the inner panel. The inner panel is placed inside the outer panel with the raised beads facing away from the outer panel. Then the edge of the outer panels is hemmed over the edge of the inner panel by a hemming punch having a plurality of slots therein located to register with the raised beads of the inner panel so that the outer panel is coined over, and a complementarily shaped raised bead nested onto, the inner panel raised beads to thereby interlock the inner and outer panels together against relative movement. The inner panel raised beads are stated to preferably have a height at least equal to the thickness of the inner panel, and are preferably elongated in shape with the elongation extending in the direction either parallel or perpendicular to the edge of the panel. The slots in the hemming die are stated to preferably have a length longer than the mating raised bead of the inner panel to allow at least one millimeter of clearance between the panels at each end of the beads.

However, the '734 bead-on-bead method does not provide the same mechanical interlock strength as the aforementioned punched hole method in which the outer panel flange is pressed coined into the hole of the inner panel as shown in FIG. 4 of the '734 patent. Additionally, the '734 method necessarily results in an undesirable overall increase in the thickness dimension of the hemmed flange as compared to the prior punched hole method.

Another problem common to both such prior art methods has been found to arise as a result of the interlock holes or the raised interlock beads being initially formed in the edge of the inner panel concurrently with punching principal locating point (PLP) holes. These PLP holes are used for properly reorienting the inner panel alone and also often marrying to the outer panel in successive downstream fixturing and processing steps involved in producing a hem flange interlock of the panels. Typically the PLP locating holes are punched through the inner panel by a piercing tool in the same stage of progressive die forming in which the interlock holes or raised beads are formed. The raised beads, like the interlock holes, can and do shift a small amount in their location relative to that of the PLP holes of the inner panel due to minute changes in the inner panel three-dimensional contour and configuration during the subsequent downstream processing and transferring steps involved prior to and in the hemming station(s). Such dimensional changes have been found to occur primarily as a result of various hardware components being subassembled to the inner panel before it is married to the outer panel. Such components typically are fastened by means of spot welding.

For example, after being finished stamped, the inner panel for a vehicle body front or rear side door goes through a pre-assembly procedure which involves assembling and welding various components fixedly onto the inner panel, such as a hinge reinforcement, an impact or crash bar, possibly also a window belt reinforcement member, a lock striker reinforcement piece, etc. The stresses introduced in this subassembly process become "locked in" and thereby introduce a small but measurable change in the location of the interlock holes or raised beads relative to the PLP holes. Moreover, shifts in location are not necessarily uniformly predictable from part to part.

Accordingly, in the downstream final hemming operation, when it is desired to deform the metal of the folded down flange of the outer panel either into an interlock hole or over a raised dimple, the location of these potential interlock points on the inner panel may have shifted relative to the design orientation of the forming tooling provided in the final hemming steel of the hemming machine or in a separate staking station downstream therefrom. De-registry of the outer panel metal, as worked by the forming tool, with its intended location relative to the interlock hole or raised bead or dimple thus can and often does result, thereby causing an imperfect or defective interlock joint at such de-registered locations in the hemmed inner and outer panels.

Preferably in the downstream hemming process stage a hemming press of the improved type disclosed and claimed in U.S. Pat. No. 5,457,981, issued Oct. 17, 1995 and assigned to Western Atlas, Inc. of Warren, Mich., assignee of record herein, (which is incorporated herein by reference) is employed to perform in one station both a prehemming operation that bends the lip edge of the outer panel to an acute included angle with respect to the outer panel, and then a final hemming operation to completely bend the pre-hemmed edge of the inner outer panel over the peripheral edge of the reinforcing panel to thereby secure and attach the panels together as a unitary structural member for assembly on a vehicle. However, in some cases the outer panel, due to its three-dimensional cambered geometry, cannot be stamped so that the lip flange around the outer periphery of the outer panel remains at a right angle to the adjacent portion of the outer panel. In such situations, it is preferred to use a separate prehemming station employing the improved prehemming machine as disclosed and claimed in U.S. Pat. No. 5,507,165, issued Apr. 16, 1996, to William R. Hartley (inventor herein) and also assigned of record to Western Atlas, Inc. (the disclosure of which is also incorporated herein by reference). It of course would be highly desirable from an efficiency standpoint to combine the interlock cold forming operation with the final hemming operation, such as in the manner suggested in the aforementioned '734 patent and particularly by employing the improved dual pre-and-final hemming press machine of the aforementioned '981 patent. However, upstream processing-induced shifting of interlock holes or dimples has hitherto posed a serious obstacle to achieving successful registry of staking tooling, if provided in the hemming steel, with the interlock holes.

In any event, regardless of the mass production operations and precision equipment hitherto utilized in constructing and assembling the inner and outer panels, the problem of de-registry of the panel interlock holes or dimples with the principal locating points of the inner panel still remain. This condition results in the possibility of panels loosening from each other, becoming skewed with respect to each other, resulting in a finished hemmed assembly of lesser quality and poor structural integrity. An assembly with these characteristics may have to be repaired or scrapped, thereby increasing production cost and lowering profits. Even worse, an ill-assembled structural member with these flaws when incorporated into an assembled vehicle may fit poorly and affect perceived quality by prospective purchasers, thereby reducing vehicle sales and profits. An assembled defective structural member may further lose integrity as the vehicle is subjected to road vibration during use and possibly require replacement and thus negatively impact an owners future vehicle purchasing decision.

OBJECTS OF THE INVENTION

Accordingly, among the objects, features and advantages of the present invention are to provide an improved method, and improved apparatus for performing such method, and an improved interlock joint made by such method and apparatus, which overcome the aforementioned problems of interlock holes or beads de-registering with PLP points, eliminates the read through problem while obtaining a precise and strong mechanical interlock structure between the inner and outer panels, which produces a finished hem with improved quality of appearance tolerances, and which accomplishes the interlocking operation in an accurate, precise, automatically controlled and highly efficient manner in conjunction with the final hemming operation as performed by the combined pre-hemming and final hemming machine of the aforementioned '981 patent.

Another object is to provide an improved assembly procedure and apparatus cooperatively sequenced for performing the aforementioned method of constructing, assembling and joining inner and outer body panels by flange hemming that require only relatively simple re-work design of existing panel hemming processing lines and equipment, involve modifications thereto that are of compact construction and arrangement, accurate, rugged, reliable, durable, stable in operation, reduce defect and scrappage costs, and of economical manufacture and assembly, that produce improved panel interlock joints that have a long useful life in service and require relatively little maintenance and repair in use, and results in improved fit and finish of automatic body assemblies.

SUMMARY OF THE INVENTION

In general, and by way of summary description and not by way of limitation, the present invention accomplishes the foregoing as well as other objects by providing an improved method and apparatus for interlocking hemmed together edges of inner and outer vehicle body panels with an improved interlock joint. In the method the outer panel is separately conventionally formed to a pre-finished condition with a hemming edge border flange lip bent up from a peripheral margin of the main vehicle-interior-facing (inboard) surface of the outer panel. The inner panel is specially processed in a production line system wherein an inner panel starting blank is conventionally draw stamped to a desired size and shape, and to have a generally flat border and a main central portion offset inboard from the border in vehicle end use. The inner panel is then die trimmed to finish the border of the stamped inner panel pre-form to desired outside dimensions. Then an inner panel and hardware component sub-assembly is built up in a subassembly welding fixture station by attaching a plurality of conventional hardware components by welding to the inner panel. Next, either in this welding station or in a next successive separate downstream pierce-after station, a plurality of interlock holes are formed in the inner panel border. This is done by individually piercing out the holes in the border with an accurately located piercing tool moving through the border from the outboard side to the inboard side of the border and while the inner panel is held located in a predetermined orientation relative to the piercing tool travel path.

Then the inner panel subassembly, with such interlock holes so pierced in its border, is married to the outer panel by loosely placing the outer panel subassembly outboard side down on a locating fixture and placing the inner panel outboard side down on the inboard side of the outer panel. The outer edge of the inner panel border is disposed inwardly adjacent the raised hemming flange lip of the outer panel. Then crimping tools in the marrying station operate to crimp partially inwardly a plurality of spaced portions of the outer panel flange lip to hold the two panels temporarily assembled as so married.

The married panels are then transferred to a hemming station where they are precisely fixture positioned in a predetermined orientation relative to hemming press gates that are operable for hemming the flange lip of the outer panel over the inboard surface of the border of the inner panel. The final hemming steel of each gate carries staking punches that permanently interlock the panels, the punches being precisely located on the steel to register individually with the interlock holes. The punches are operable to permanently deform the registered portion of the final hemmed flange lip into the associated interlock hole in the inner panel border as a final and sequential operation in the hemming station.

Preferably at least two conventional principal locating point (PLP) openings are punched in the inner panel during the upstream draw stamping or die trimming of the inner panel. Then the inner panel in the pierce-after station is precision fixtured by clamps and locating pins of this station the pins being registered in the PLP openings to thereby precisely position the interlock holes as they are pierce-formed relative to the PLP openings. In the hemming station, the married panels again are precision fixtured and clamped in a hemming anvil fixture by hemming station clamps and by locating pins that are set up to be registered in the PLP openings to thereby precisely re-position each interlock hole as originally oriented in the pierce-after station. This assures precision registry with the travel path of the working stroke of an associated staking tool punch of the final steel staking means. Hence the punch-deformed portion of the outer panel hemmed flange lip is accurately centered in the associated interlock hole in a reliable, repetitive manner part-to-part in this mass production line system.

Preferably the flanging press or gate machine is also provided with stake drive means for reciprocating each staking tool punches through its working stroke in timed relation with the completion of the final hemming operation, and while the final hemming steel member is being pressed in a dwell phase against the hemmed lip in its finished fully hemmed orientation relative to the inner panel border.

Preferably the flanging press machine is a combined pre-hemming and final hemming type machine as disclosed in U.S. Pat. No. 5,457,981, and hence also includes a pre-hemming steel operable to push the outer panel flange lip from its upstanding position to an angled position overhanging the inner panel border, and then to retract clear of the panels during subsequent motion of the final hemming steel through its operation cycle. The stake drive means is then preferably mounted on the pre-hemming steel for operably driving the associated staking tool punch on the final hemming steel when the latter is fully extended on its working stroke and the pre-hemming steel is moving in its operation cycle motion.

It has long been recognized that in order to eliminate re-fitting every car or truck door with attendant man-hour cost, it is important that the inner/outer door panels are consistent in their relationship. In the method of the invention, the inner panel subassembly is located consistently in the pierce-after station only after final welding assembly of all detail to the inner panel then "after piercing" the interlock holes in the inner panel. The method and apparatus repeat that position or inner/outer panel relationship again in the hemming machine. Thus the hold down and locating pins units in the hemming station position the inside panel assembly relative to the outer skin for final car fit as well as for precise and reliable interlock joint formation. That improved result is important because, although the door is mounted or hung by the inner panel hinge reinforcement surface, what one looks at from outside of the vehicles for flush mounting, gap clearance and/or overall fit is the outer door panel.

The foregoing method and apparatus also effective to form a new and improved interlock joint for interlocking hemmed together edges of inner and outer vehicle body panels. Note that in this joint the inner panel is married and final hemmed to the outer panel with the inner panel outboard side placed down on the inboard side of the outer panel, and with the outer edge of the inner panel border disposed sub-adjacent the final hemmed flange lip of the outer panel. Note also that in this joint the interlock hole is formed in the inner panel border by a piercing tool moving through the border from the outboard side to the inboard side of the border. Hence any and all punch upset material of the inner panel border that is cold worked by the shearing action of the piercing tool punch is disposed slightly raised above and inboard of the inner panel inboard surface and around the margin of the pierced interlock hole. Then while the final steel is held by hemming press gate in its dwell position upon completion of final hemming motion, the punch operates to form the joint. In this staking operation, the interior surface of the flange lip of the outer panel is interlocked by staking of a punch-registered portion of the outer panel flange lip that is permanently deformed by the punch into the associated interlock hole in the inner panel border.

Preferably the deformed locking portion of the outer panel flange lip is centered on the interlock hole in this staking operation. Also, preferably the upset material is further worked into embedment into the interior surface of the outer panel flange lip as it is deformed by coining it into the interlock hole to thereby further strengthen the mechanical interengagement of the outer panel flange lip and the inner panel border.

BRIEF DESCRIPTION OF THE DRAWINGS

The foregoing as well as other objects, features and advantages of this invention will be from the following detailed description of the best mode, appended claims and accompanying drawings in which:

FIG. 1 is a simplified fragmentary side view of a first stage draw forming operation involved in progressive die, transfer-press-type production of the inner panel of an automotive body front side door assembly as produced in accordance with one example of the method, apparatus and interlock joint of the present invention;

FIG. 2 is a side elevational view of the inboard side of the inner panel after completion of the second stage transfer press operation wherein the outer periphery is die-trimmed to size and two precision locating point (PLP) holes are concurrently punched therein;

FIG. 3A is a block diagram indicating a pre-assembly procedure involving spot weld attachment of all hardware to the inner panel as the next successive step in the method;

DETAILED DESCRIPTION OF THE PREFERRED EMBODIMENTS OF THE INVENTION

Figure 3B:
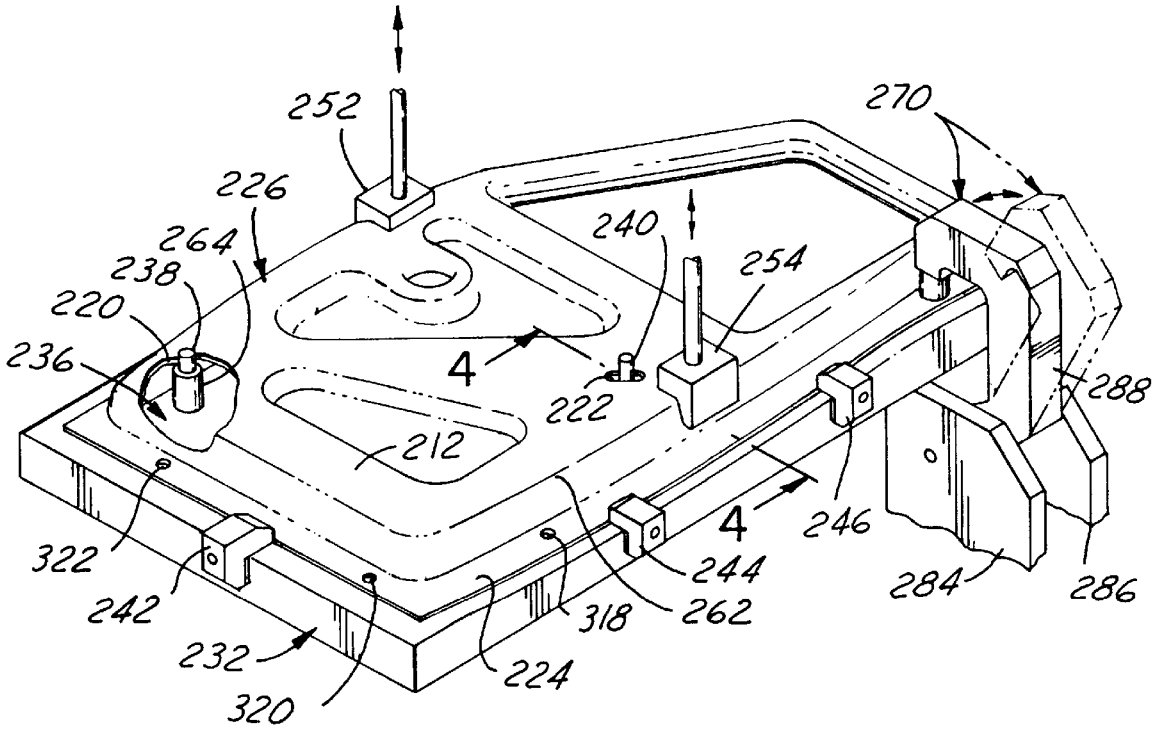
FIG. 3B is a perspective view of an inner panel piercing station wherein an array of interlock holes are formed in the peripheral flange of the inner panel after all of the hardware components have been affixed by welding to the inner panel.

Referring in more detail to the accompanying drawings, FIGS. 1–27 generally illustrate in sequence the improved method, the conventional as well as improved apparatus employed in accordance with the invention for performing the method, as well as the improved hemmed flanged interlock joint produced by such method and apparatus in accordance with the invention. The method can be generally subdivided into three phases as applied to a working example of a front (starboard or right-hand) side door assembly for an automotive vehicle: (1) the construction of a door inner panel subassembly as partially illustrated in FIGS. 1–10; (2) then marrying of the door inner panel subassembly to a preformed door outer panel so as to be held temporarily assembled together by crimps in the flange lip of the outer door panel, as illustrated in FIGS. 11 and 12; and (3) then the operations of pre-hemming, final hemming and flange interlocking of the married panels in a hemming station as illustrated in FIGS. 13–27.

Construction of Door Inner Panel Subassembly

FIG. 1 illustrates in simplified form the draw forming stage of a transfer press operation for draw forming the initial preform of the inner panel of the side door assembly for an automotive vehicle body. This first stage of the press conventionally includes a die upper shoe 200 carried by a press ram (not shown), a stationary die punch 202 supported on a press bed (not shown), a binder ring 204 carried on gas springs (not shown) for biasing movement of ring 204 in a lower die shoe (not shown), all of conventional construction which cooperate in a conventional manner to draw form a flat starting blank 206 into a first stage preform part 208 shown in phantom cross section in FIG. 1. Typically the starting material blank 206 is a cold rolled mild flat sheet of steel of uniform thickness, for example 0.030 inches in thickness. Draw stamped preform part 208 has a peripheral flat flange portion 210 surrounding a raised main central portion 212 that is off set from the plane of flange 210 in a direction that will be toward the interior of the vehicle when the finished door assembly is assembled to a vehicle body. For clarity and convenience, the terms "inboard" and "outboard" are used herein with reference to directions respectively toward the interior and the exterior of the vehicle body in the end-use assembled condition of the finished door assembly and its components as oriented in assembly onto a vehicle body. Thus, the central portion 212 of the stamping is offset "inboard" from flange 210.

Preform 208 is successively transferred through suitable, conventional downstream progressive die stations to punch out various openings as shown in FIG. 2, such as a window opening 214 and flanged pockets 216 and 218, as well as two principal locating point (PLP) through holes 220 and 222. PLP opening 220 is circular, whereas PLP opening 222 is oblong with its major axis oriented to intersect (by imaginary extension) PLP opening 220. As also indicated in FIG. 2 the peripheral marginal flange portion 210 has also been die trimmed to form the border flange 224 to final outside contour in plan view. The door inner panel stamping 226 thus formed (FIG. 2) is shown for convenience in several of the views as a flat planner member, but it is to be understood that typically both the door inner panel and door outer panel have compound curvatures about all three dimensional axis X, Y and Z, as more accurately illustrated in FIGS. 13 and 14.

Figure 4:
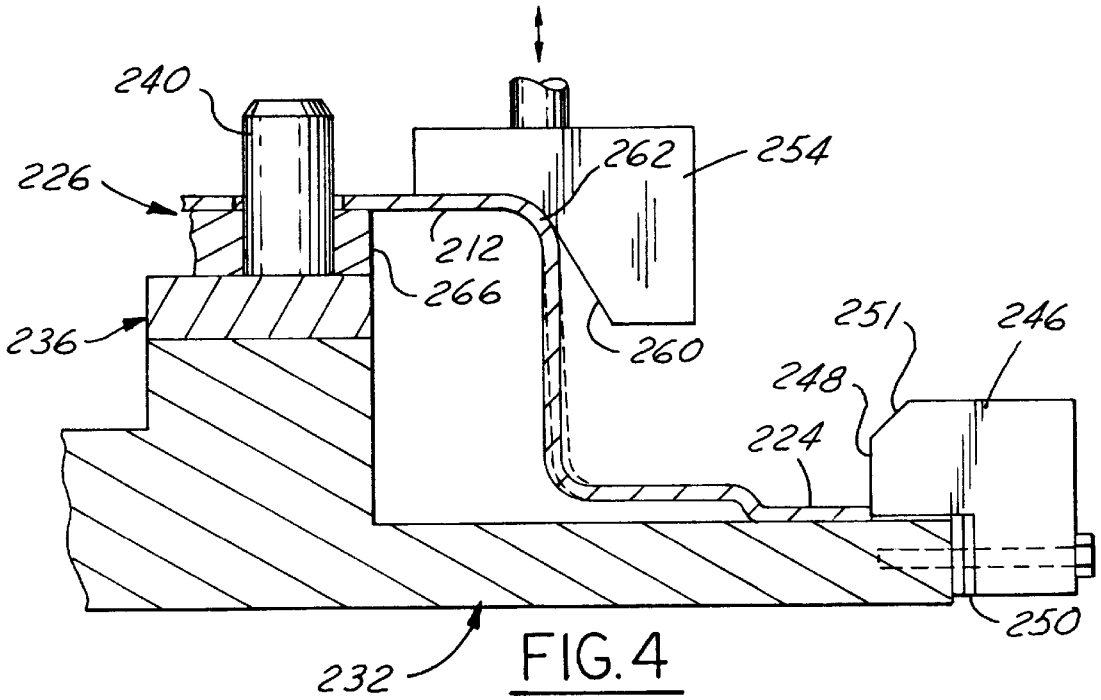
FIG. 4 is a fragmentary sectional view taken on the line 4—4 of FIG. 3B.

It is to be noted that, at the completion of the stamping stages of FIGS. 1 and 2, and in accordance with one feature of the invention, no interlock holes or raised beads have been formed as yet in the peripheral flange 224 of inner panel 226 during these otherwise conventional progressive draw forming and die stamping operations represented by FIGS. 1 and 2. This is contrary to the practice in the earlier prior art method referenced at FIG. 4 in the aforementioned Polon U.S. Pat. No. 5,237,734. In such prior art the interlock holes are formed by downwardly traveling punches, similar to and concurrently with those used to form PLP openings 220 and 222, in order to enable gravity drop out of the punched out scrap slugs, and thus with the punches on their working stroke exiting from the inner panel stamping at the outboard surface thereof. As shown in FIG. 4 of the '734 patent, this often produced a burr and/or outwardly deformed hole margin at the outboard surface of inner panel 72. Such distortion was therefore likewise imparted during hemming to the outboard surface of the outer panel 70, thereby resulting in the "read through" problem in the finished product that the '734 patent process was intended to overcome by forming raised dimples instead of interlock holes in these preliminary stamping stages.

Referring to the block diagram of FIG. 3A, this next stage may be conventional component sub-assembly station provided with a suitable welding fixture set up of conventional construction (not shown). In this station various door hardware and structural components required in the completed door assembly are affixed to inner panel 226 by welding. Although these conventional components are not shown, it will be understood that they typically constitute hinge reinforcement pads, an impact or crash bar, possibly also a window belt reinforcement bar or beam, possibly also a lock striker reinforcement piece, etc. These add-on components are typically affixed by spot welding onto the inboard side of inner panel 226, although some may be spot welded onto the outboard side of panel 226. Typically the outside dimensions of inner panel 226 will unavoidably change slightly during such component pre-assembly processing in the welding fixture of the subassembly station (FIG. 3A) due to welding heat and/or welding fixture induced distortions. For example the width of the inner panel will often "grow" (increase) during installation of the side impact reinforcement bar structure. Hence, in the prior art processing, wherein interlock holes or raised dimples are formed in the inner panel peripheral flange 224 prior to transfer to component assembly welding fixture, the initial as-formed location of the such interlock hole or bead features in the peripheral flange relative to the PLP points 220 and 222 will be moved as a result of this preassembly procedure of FIG. 3A. However, in accordance with one feature of the method and interlock construction of the invention this "growth" or "shift" movement problem is avoided by incorporating a "pierce-after" feature into the processing of the inner panel.

Figure 5:
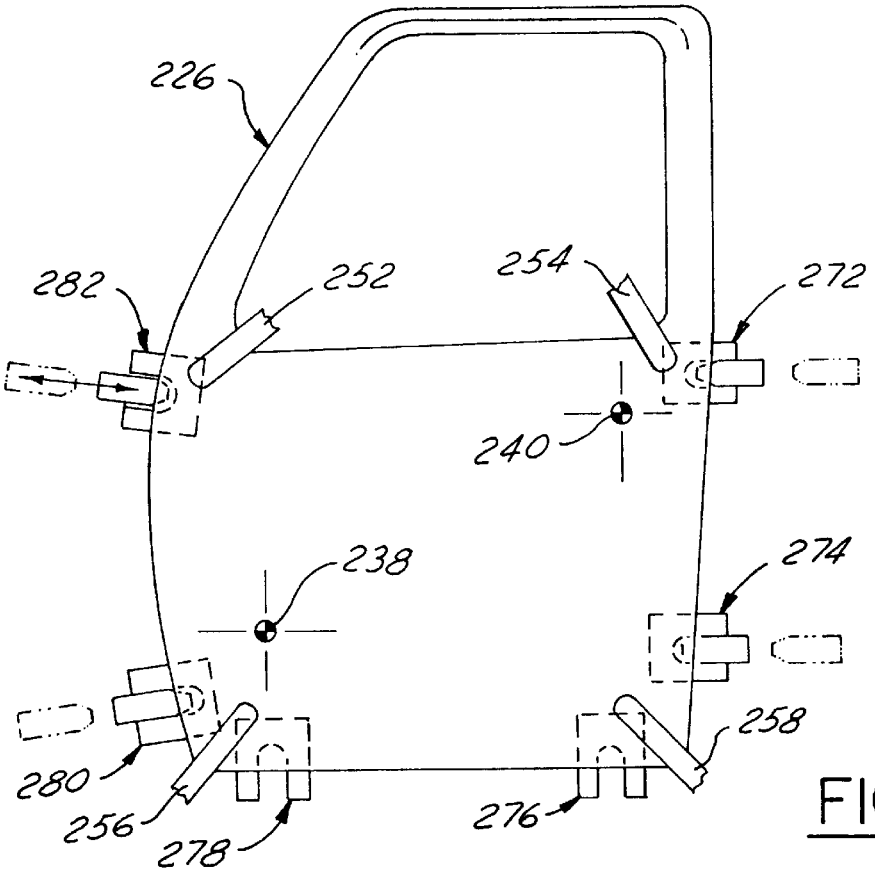
FIG. 5 is a simplified plan view in semi-schematic diagrammatic form illustrating interlock hole piercing and fixturing apparatus and operations performed in the pierce station of FIG. 3B.
Figure 6:
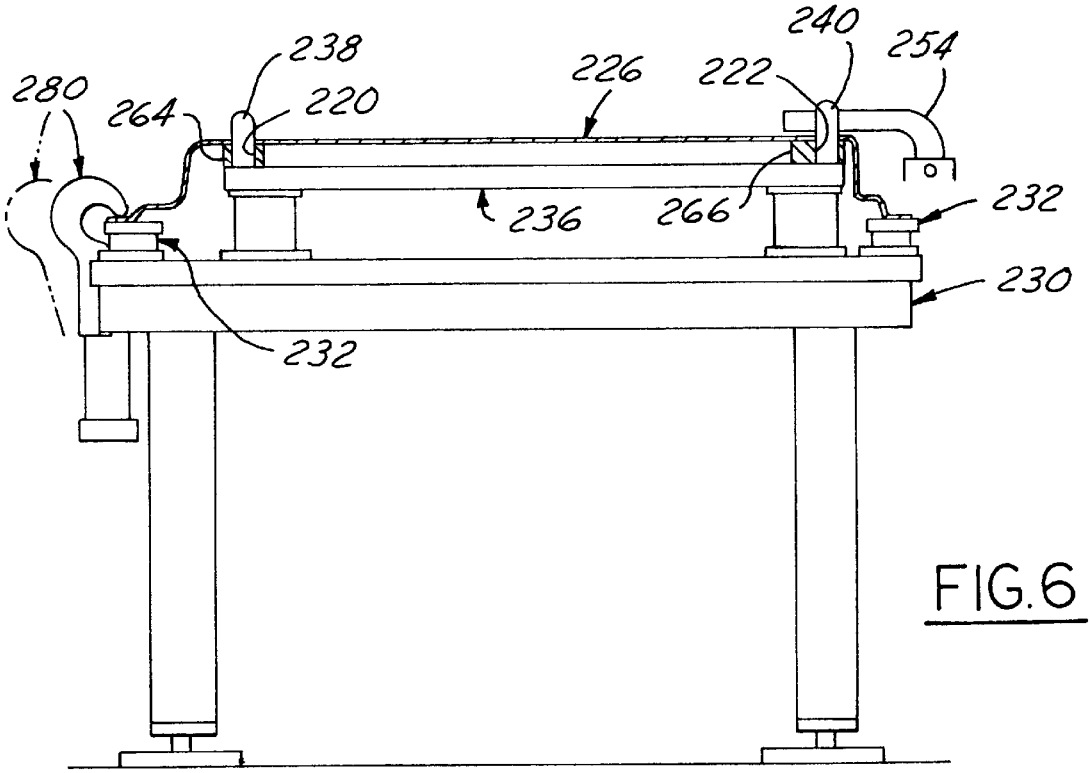
FIG. 6 is a simplified semi-diagrammatic view in side elevation further illustrating the operations performed in the piercing station apparatus of FIG. 3B.
Figure 7:
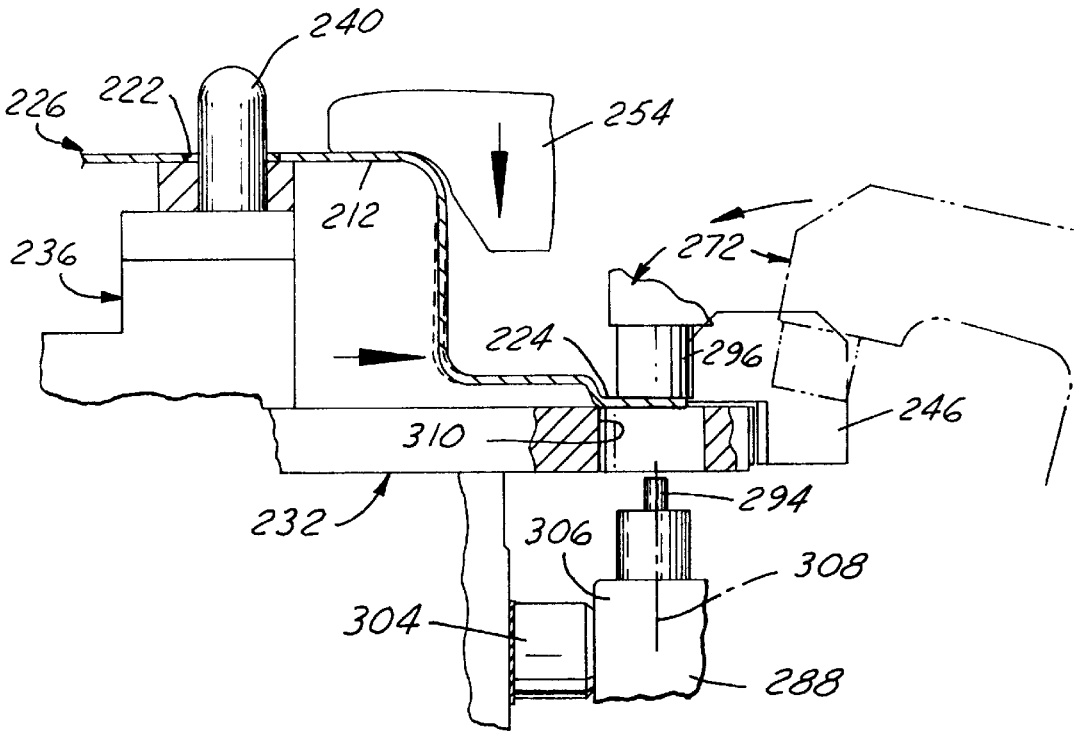
FIGS. 7 and 8 are fragmentary side elevation semi-diagrammatic views further illustrating the operation of one of the interlock hole piercing tools employed at the piercing station of FIG. 3B, and sequently illustrating motions of the tool during its operation in the process.
Figure 8:
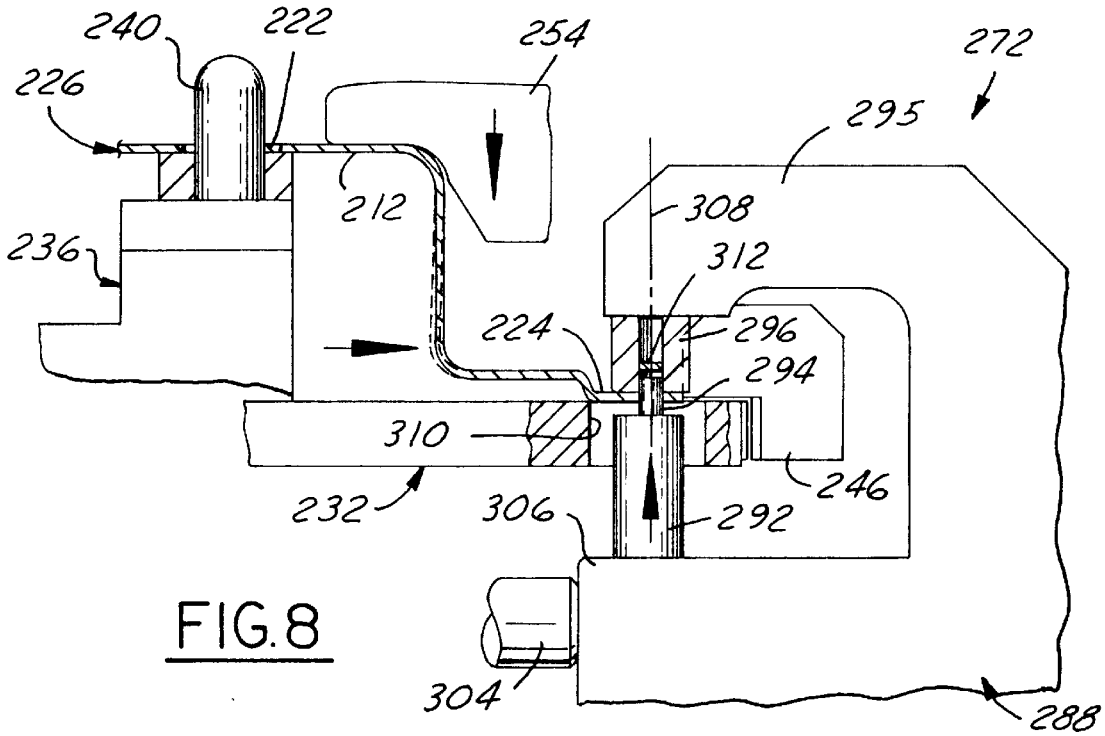

Thus referring next to FIGS. 3B and FIGS. 4–9, door inner panel 226, with all of the hardware components affixed thereto by welding, is transferred to a pierce-after station and placed outboard side down on a fixture table 230 (FIG. 6). This station includes an array of foundation plates 232 supported on the top of a table 230 to present an upper surface contour adapted to receive the inner panel peripheral flange 224 flat thereagainst. Table 230 also supports a positioning pin fixture 236 which in turn fixably carries a pair of cylindrical precision PLP locating pins 238 and 240 which protrude vertically upwardly from fixture 236 for registry through PLP holes 220 and 222 respectively to thereby accurately locate panel 226 relative to the components of fixture table 230. In addition, a series of gauge stop blocks are arrayed around the outer edge of the foundation plate array 232, as best shown in FIG. 3B, wherein three of the gauge blocks 242, 244 and 246 are shown as adjustably fastened by threaded fasteners to the outer edge of foundation 232. As best seen in FIG. 4, the precision flange-abutment gauge surface 248 of each gauge block 246 is precision located during set-up by suitable shims 250.

As best seen in FIG. 4, each of the gauge stop blocks 242, 244 and 246 has a beveled surface 251 to assist in locating panel 226 as the same is lowered onto foundation plates 232 for registry of the PLP openings 220 and 222 with PLP pins 238 and 240. The gauge blocks thus facilitate initial registry and seating of the panel on the foundation, but the finite precision location of the panel is finally set and determined by the registering of the PLP pins 238 and 240.

After inner panel subassembly 226 is initially seated on foundation 232 and located thereon by PLP pins 238 and 240, panel 226 is firmly clamped in such position by a plurality of suitable fixture hold down clamps, such as the four clamps 252, 254, 256 and 258 schematically illustrated in FIGS. 5 and 6, and semi-schematically illustrated in FIGS. 3, 4, 7 and 8. Each hold down clamp is suitably contoured on its clamping surface 260 (FIG. 4) to seat on the associated portion of the inboard, upwardly oriented surface of the offset central portion 212 of panel 226, and also to partially curve around and grip the associated outer peripheral corner edge portion 262 of panel portion 212 (FIGS. 3 and 4). Hold down clamps 252–258 are constructed and arranged so as to exert a predetermined downward clamping pressure on panel 226 to ensure full seating of peripheral flange 224 on the seating surface of the foundation plate array 232, and also to seat portion 212 on spacer blocks 264 and 266 associated with pins 220 and 240 respectively (FIGS. 3B, 4 and 6).

In accordance with a primary feature of the present invention, the pierce-after fixture station is constructed and arranged such that when panel subassembly 226 is located by its principal locating points and so clamped onto the foundation plate array 232, panel 226 assumes identically the same configuration and contour that it will later assume in the downstream hemming fixture station of FIGS. 13 and 14. That is, when panel 226 is later placed in the hemming fixture as still loosely married with the outer panel 332 the married panels are located and clamped in such married assembly while simultaneously precisely re-positioning the inner panel to duplicate the position of the inner panel as positioned and clamped in the pierce station of FIG. 3B.

Thus the pierce-after station foundation plate array 232 is constructed to closely approximate in platform contour the like contour of the hem die post or anvil of the hemming station. Also, the hold down clamps 254–258 in the pierce station are duplicated by the hold down clamp set-up in the hemming station, at least as to their respective clamping positions and hold down pressures exerted on the inner panel for forcing it down on the outer panel as the latter is backed-up by the piercing and hemming station anvils. Only sufficient clamping force is designed into the clamping fixtures to ensure a stable, snug-down fit of the peripheral flange 224 on the seating surfaces of the foundation plate array 232 so as not to unduly distort inner panel 226 and its sub-assembled hardware components. The peripheral array of gauge blocks 242–246 surrounding all side and end edges of panel 226 are set by shims 250 so that their gauge stop surfaces 248 can accommodate any spreading in the overall length and width dimensions of panel 226 when fully clamped in the pierce station, as empirically established in set-up and pilot run try-out of the fixture and hold down clamps.

Then the interlock holes are pierced in the peripheral flange 224, but only after the inner panel subassembly 226 has been precisely located and fixtured in the pierce fixture as set forth above. Hence in accordance with the present invention the location of each of the interlock holes relative to the principal locating points 220 and 222 of the panel is initially established in the pierce-after station, and then is re-established precisely in the same relative locations by the manner of so duplicating the fixturing and clamping of the married inner and outer panels in the hemming station.

The pierce-after station is provided with a plurality of suitable pierce tool units, preferably one each for each of the plurality of interlock holes to be formed in inner panel peripheral flange 224. One of such piercing units 270 is shown in FIG. 3B. In FIG. 5 an additional six pierce units 272, 274, 276, 278, 280 and 282 are schematically shown, each of such units being identical to unit 270 but located individually adjacent the associated hole piercing location of the foundation plate array 232. Each piercing unit 270–282 comprises a pair of yoke frame plates 284 and 286 (FIG. 3B), immovably affixed either directly or indirectly to the foundation plate array 232, and an associated piercing tool 288 pivotally mounted between plates 284 and 286 for pivotal motion between retracted and piercing positions shown respectively in phantom and solid lines in FIGS. 3B, 6, 7 and 9.

Figure 9:
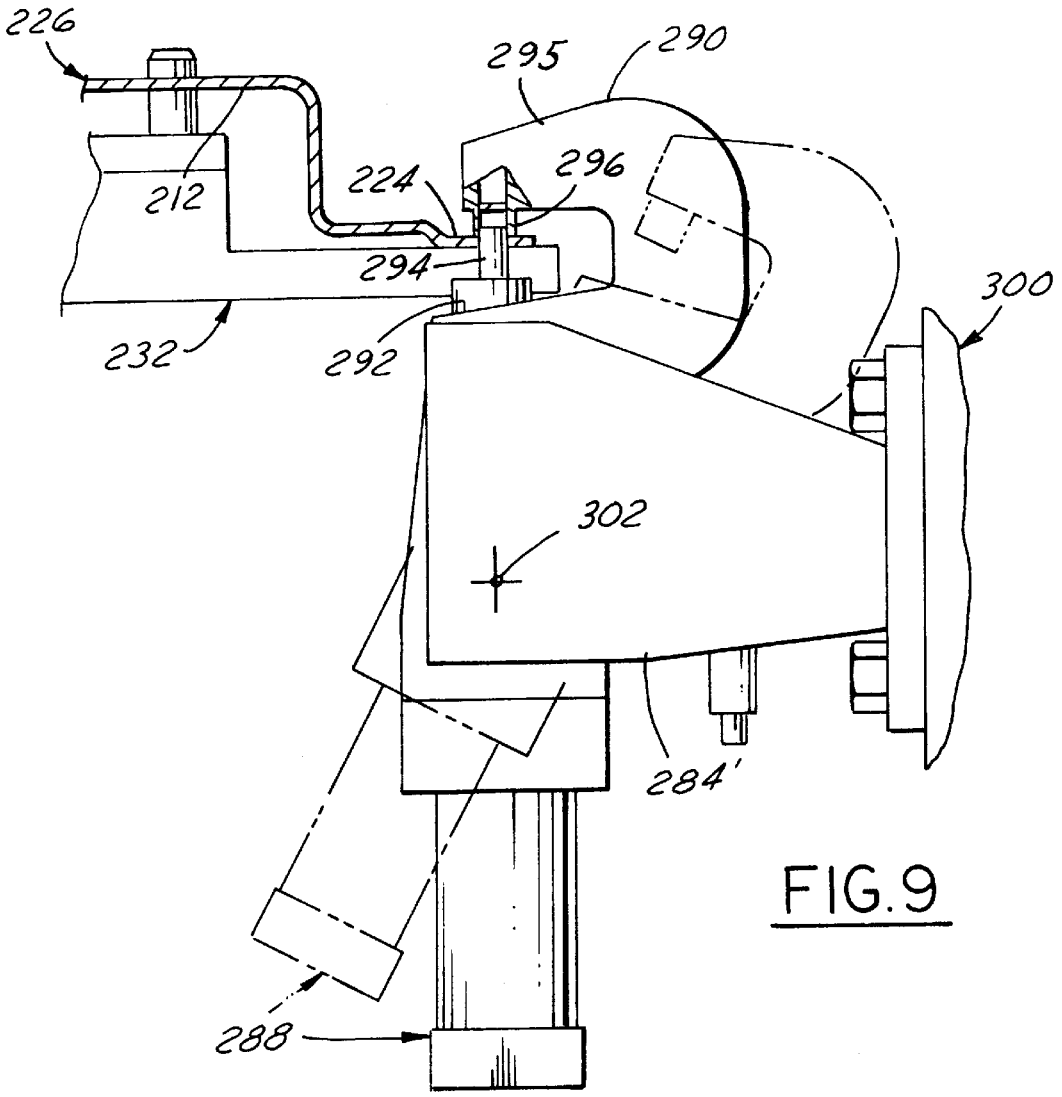
FIG. 9 is a fragmentary part sectional, part side elevational view showing in more detail the mounting and operation of a commercial piercing tool corresponding to that shown in FIGS. 3B and 5–8.

Piercing tool 288 may be a commercially available conventional piercing unit, such as the pneumatic cam tip equalized pierce unit, Model PEH-1579, made by Wes Industries, Inc. of Troy, Mich having a unit capacity of 1650 pounds at 60 psi air supply pressure, and illustrated in FIG. 9. These units have a horse shoe anvil head 290 and associated pneumatic cylinder power unit for reciprocally driving a piston 292 carrying a piercing punch tool 295. The upper arm 294 of the anvil carries a female die 296 aligned coaxially with pierce punch 294 in the piercing position. An alternate frame plate mounting 284' for tool 288 is shown in FIG. 9, the same being mounted to framework structure 300 located adjacent pierce fixture station table 230. Tool 288 is mounted for pivoting motion about the pivot axis 302 in the frame plates. In the tipped-back, retracted position (indicated in phantom) of the piercing tool, the same clears the foundation plate array 232 to facilitate unloading and loading of the inner panel subassembly 226 at the pierce station. Preferably each piercing tool 288 is automatically tilted between retracted and piercing positions by suitable pneumatic actuators (not shown) of conventional construction, and tools 288 are automatically controlled in a conventional manner to operate simultaneously through their working cycle.

The pierce-after station fixture table 230 is provided with a plurality of hard stop buttons 304 (FIGS. 7 and 8), one for each piercing unit 272–282, against which the lower arm 306 of tool 288 abuts to set the end limit of the tip up stroke of the tool and to accurately align the axis 308 of punch 294 and die 296 relative to the principal locating pins 238 and 240 of the pierce-after fixture. Foundation plate array 232 is provided with suitable clearance openings 310 (FIGS. 7 and 8), one at each pierce unit station, to permit the upward travel therethrough of piston 292 and its associated pierce punch tool 294 during its upward punch-piercing stroke from the position shown in FIG. 7 to the position shown in FIG. 8. During this piercing stroke punch 294 penetrates through inner panel peripheral flange 224 to form the associated interlock hole therein, while driving the scrap slug 312 (FIG. 8) up into die 296. The slugs are ejected from the die during tilting of the tool back to the retracted position.

After the array of interlock holes 314–324, etc. have thus been precision punched in the peripheral flange 224 of inner panel subassembly 226, the same is de-fixtured from the pierce-after station and transferred to a marrying station. The inner panel subassembly 226 is shown by itself in perspective in FIG. 10 as so punched. It will be seen that three interlock holes 314,316 and 318 have been punched through the rear edge of flange 224, two interlock holes 320 and 322 have been punched through the bottom edge of the flange and corresponding interlock holes formed in the front edge of flange 224 (as indicated by interlock hole 324). Preferably the configuration of the interlock holes is cylindrical, but alternatively one or more, or all of the interlock holes may be made oblong in plan configuration, preferably with the major hole opening dimensional axis extending parallel to the adjacent edge of flange 224, by suitably configuring the punch and die of the piercing tool to match the hole shape desired.

From the forgoing it will now be understood that, in accordance with another principal feature of the present invention, each interlock hole is formed by piercing with the punch 294 first engaging the outboard surface of flange 224 and then moving through the material of the flange and exiting through the inboard surface of flange 224. Thus any burrs and/or hole margin upsetting resulting from the punching operation will be formed at the inboard edge of the interlock hole and thus protrude inboard from this surface, rather than from the outboard surface of flange 224 as in the prior art discussed previously. Such upset metal is shown in broken lines at 430' and 432' in FIG. 27.

In accordance with another principal feature of the present invention it also will now be understood that each of the interlock holes so formed in the pierce-after station will be located in a precision manner and geometrically oriented relative to the principal locating point PLP openings 220 and 222 of panel 226 in precisely the same relationship as these holes will assume when fully fixtured and clamped in the downstream hemming station fixture. Preferably the abutment stop surface 248 (FIG. 4) of the stop gates 242, 244, 246 etc. will be set by their associated shims 250 so that the outer peripheral trimmed edge of flange 224 will abut this surface when the inner panel is fully clamped as described in conjunction with the FIGS. 3B, 4, 5 and 6. Orienting stop surfaces 248 are set up to duplicate the subsequent position (after hemming fixturing) of the inner surface of the upright flange lip of the outer panel as initially formed in the stamping operation of the outer panel 332, as described in more detail hereinafter.

It will also be understood that the pierce-after station of FIGS. 3B–9 can be combined with a welding fixture station wherein the pre-assembly procedure and welding of all hardware as indicated in FIG. 3A is also performed. The welding attachment procedure may be performed prior to actuating clamps 252–256 for the piercing operation, or alternatively, the pierce-after clamps 252–256 and fixture gates 242–246 can also be used in conjunction with the welding operation for affixing the various hardware components to the inner panel 226. In either event the inner panel subassembly 226 prior to the interlock hole piercing operation is to be precisely fixtured by the principal locating points through registry with the PLP pins 238 and 240 and the panel precision final clamped to bring the outer edge of flange 224 snug up against the abutment gauge surfaces 248' of the stop gates prior to operation of the hole piercing units 272–282.

Marrying Station

Figure 10:
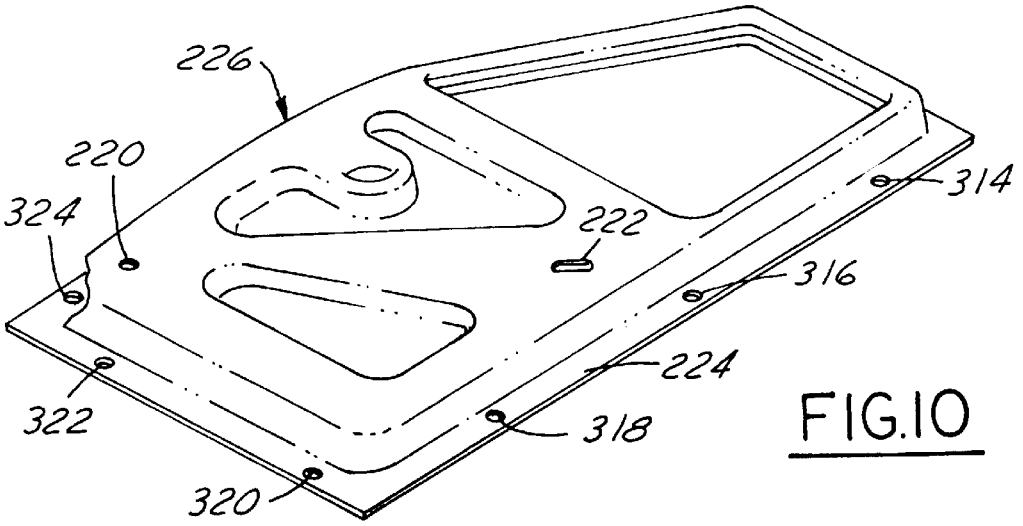
FIG. 10 is a simplified perspective view of the door inner panel after being processed in and removed from the piercing station of FIG. 3B.
Figure 11:
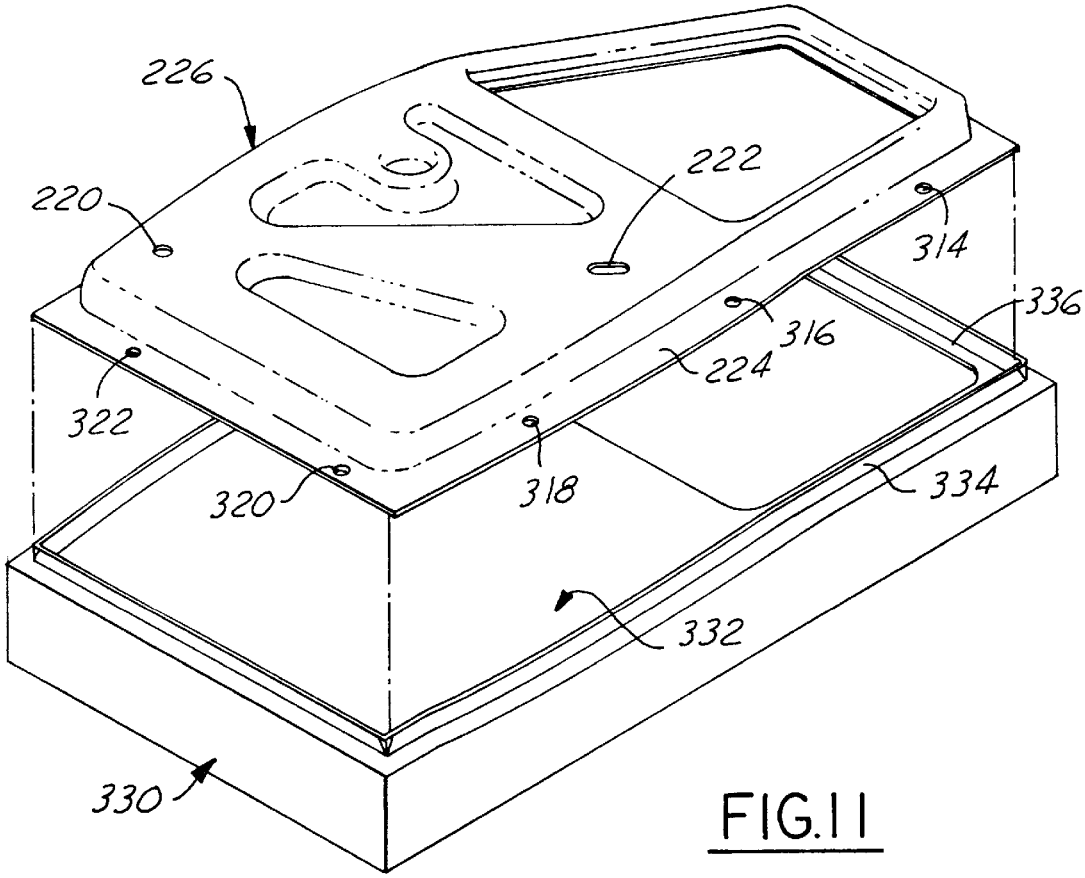
FIG. 11 is an exploded simplified perspective view illustrating the loading of the door inner panel of FIG. 10 onto a separately pre-formed door outer panel that in turn is supported on a fixture anvil in a conventional marrying station.
Figure 12:
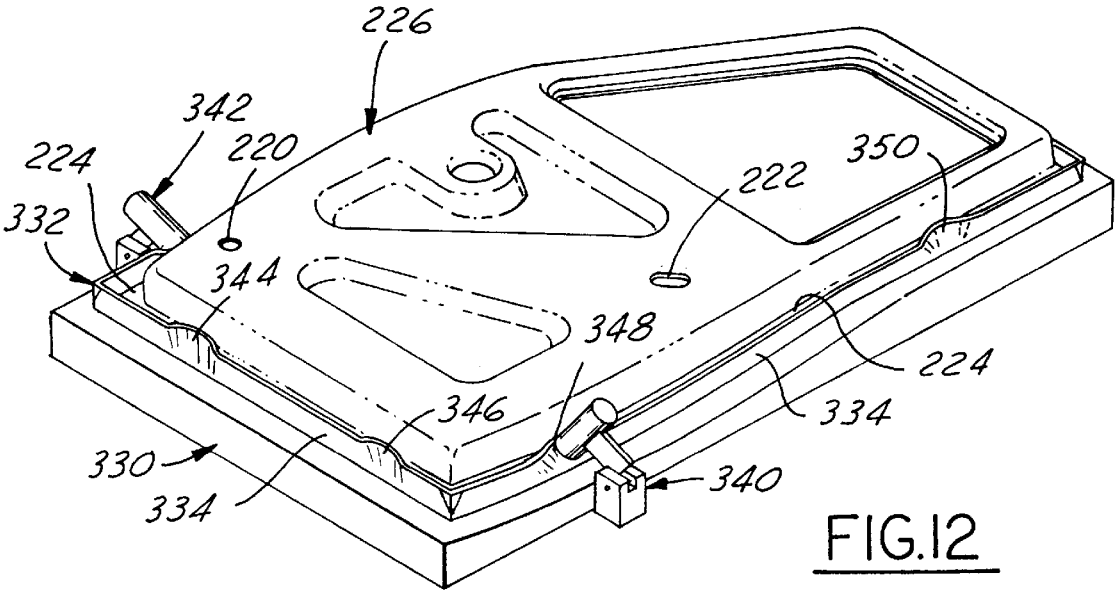
FIG. 12 is a perspective view illustrating the door inner panel nested in the door outer panel in the marrying station, and the operation of crimping or clinching portions of the outer panels flange lip to temporarily "tack" assemble loosely together the inner and outer panel in the marrying station.

In the next stage of the method of the invention illustrated in FIGS. 11 and 12, the inner panel subassembly 226, with the interlock holes pierce-formed therein as shown in FIG. 10, is transferred to a conventional marrying station. Although inner panel 226 and outer panel 232 are shown in simplified form to be generally flat members in FIGS. 11 and 12, it is to be understood that they typically have a compound curvature and contour more closely approximates the showing thereof FIGS. 13 and 14. The marrying station includes a die rest or anvil 330 having its upper surface contoured to match the outboard surface contour of an associated pre-formed door outer panel 332 in its as-stamped free-state contour, outer panel 332 being first transferred and so seated on this surface. Then the inner panel subassembly 226 is transferred and lowered into loosely nested position within the confines of peripheral lip 334 of outer panel 332 for marrying thereto as shown in FIGS. 11 and 12.

In the conventional progressive die stamping manufacture of outer panel 332 the same is formed with the substantially circumferentially continuous upstanding flange lip 334 that typically protrudes inboard from the inwardly adjacent peripheral border flange area 336 of outer panel 332 and generally perpendicularly thereto, i.e., the included angle between lip 334 and flange 336 is about 90° (FIG. 11). In some instances, as indicated previously, this angle may be an obtuse angle due to camber and varying contours in the edge of door panel 332. Nevertheless the corner junction of lip 334 with flange 336 in the final stamped condition of outer panel 332 is a fairly precise and repeatable geometric position part-to-part. Hence lip 334 as designed is utilized to serve as an abutment stop for the outer edge of the peripheral flange 224 of inner panel 226 in the downstream final hemming assembly of the inner and outer door panels.

As shown in FIG. 12, the marrying station operation involves a series of conventional retractable lip-clenching or crimping tools 340 and 342 that operate to bend in a small portion of lip 334 at suitably spaced locations to form a series of crimps, such as shown in FIG. 12 at 344, 346, 348 and 350, that suffice to hold inner panel subassembly 226 loosely assembled with outer panel 332 but secure enough for subsequent removal from the marrying station and transfer on conventional transfer equipment to the downstream flange hemming stages.

Hemming and Flange Interlocking of Married Panels

Figure 13:
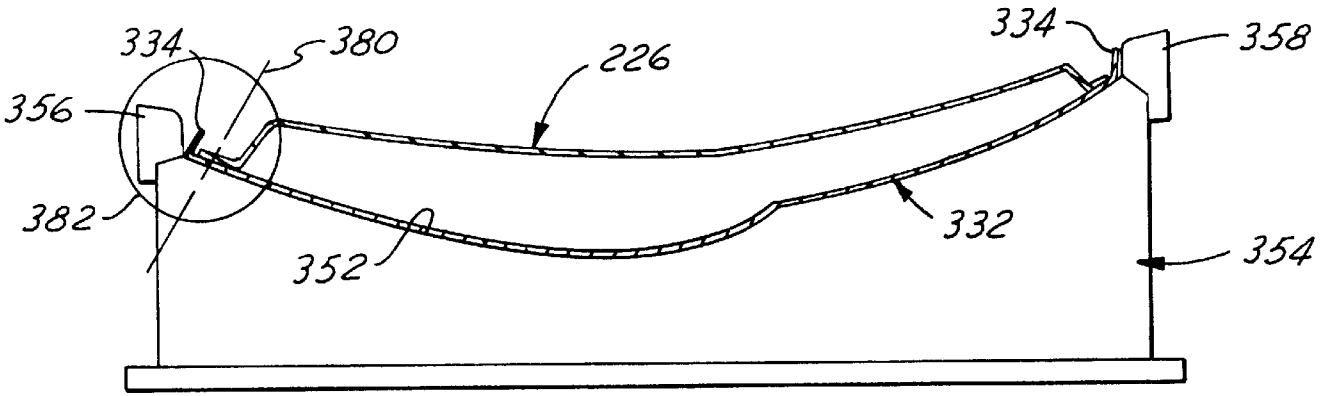
FIG. 13 is a simplified side elevational view of a hemming station anvil fixture with the loose clinched assembly of the inner and outer panels resting thereon, but illustrating more realistically the typical compound curvature of these panels in the plane of the drawing.

Referring to FIG. 13, in the next stage the loose married assembly of inner panel subassembly 226 with outer panel 332 is loaded (by the conventional transfer and loading equipment, not shown) downwardly onto a precision contoured seating surface 352 provided on the conventional hemming station anvil 354. As the married assembly is lowered onto anvil 354, a series of perimeter gauge blocks 356 and 358, preferably provided two on each of the four sides of anvil 354, serve to guide and locate outer panel 332 to accurately position the lip break line of the outer panel on the anvil 354. However it is to be noted that the inner panel subassembly 226 is still only loosely assembled (as married) on outer panel 332, and hence not as yet accurately precision positioned as to the location of the interlock holes 314–322, etc., nor as to its peripheral flange 224, either with respect to die seat 352 of anvil 354 or with respect to flange lip 334 of outer panel 332.

Figure 14:
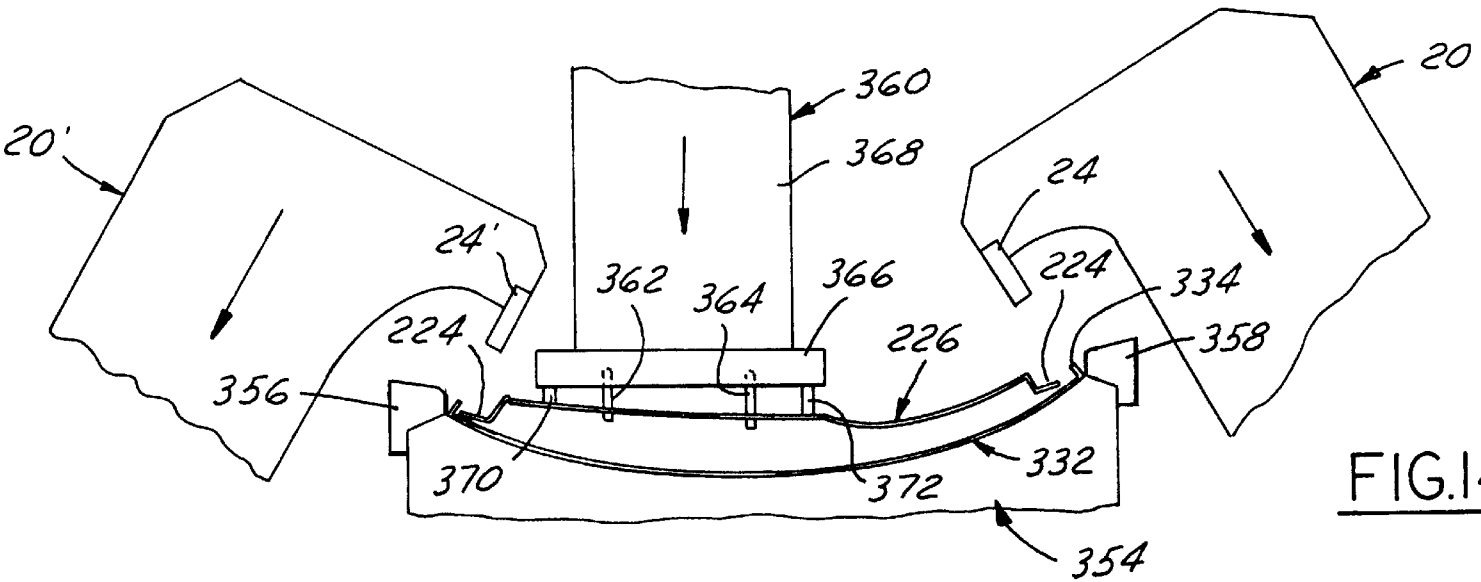
FIG. 14 is a fragmentary diagrammatic and simplified view of the hemming station illustrating a hold down clamp carrying positioning pins and engaging the inboard side of the inner panel, and a pair of pivotally supported hemming presses, tilt-oriented for performing flange hemming operations on opposite side edges of the inner/outer panel assembly as so fixtured.
Figure 19:
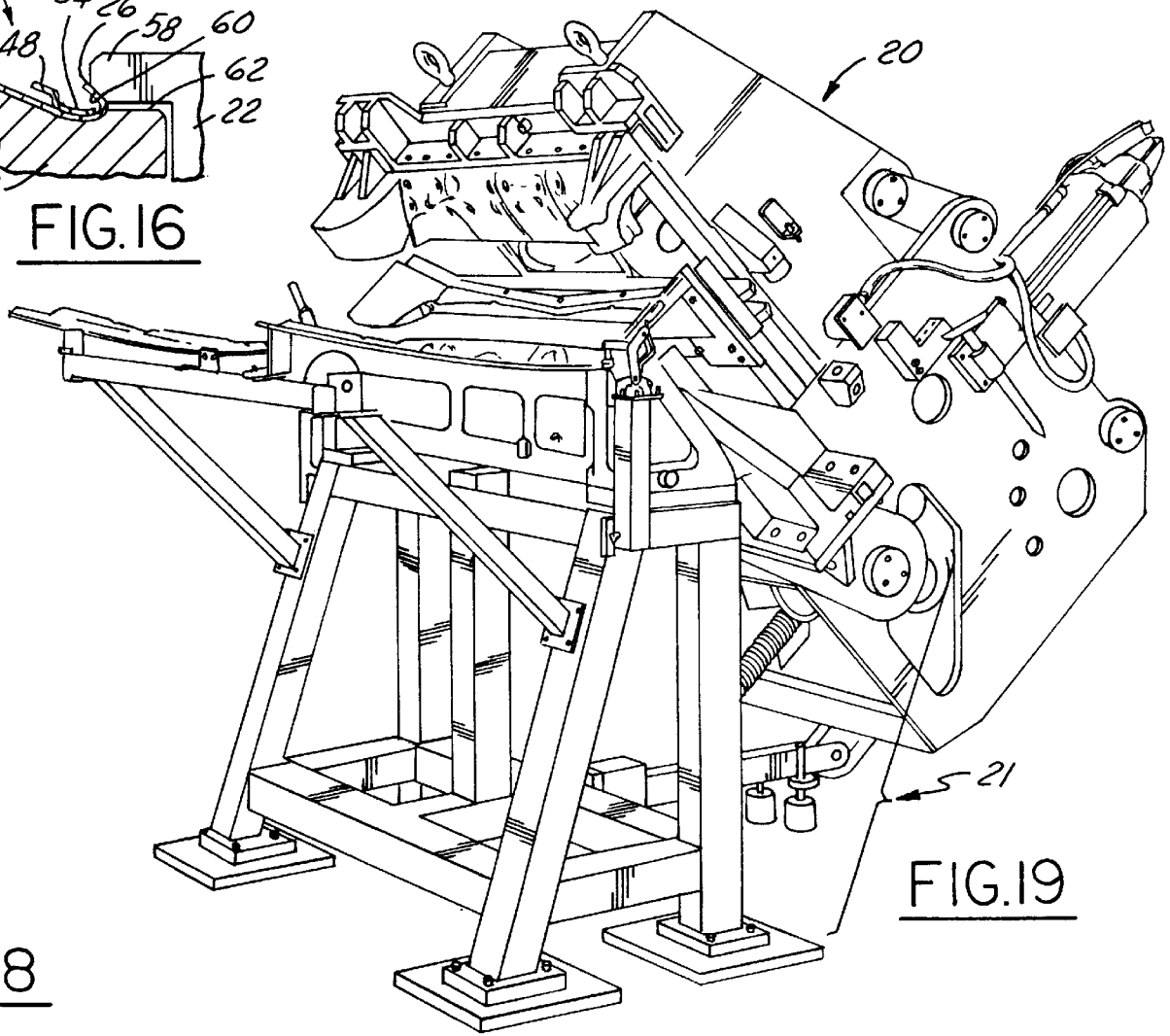
FIG. 19 is a perspective view of a combined prehemming and final hemming press as commercially constructed in accordance with the '981 patent and pivotally mounted on a supporting frame work so that press can be titled by stub shafts affixed to its outer plates and received in the cradle-like base illustrated in FIG. 19, the tilt mounting facilitating insertion in, removal from and the transfer of the panels through the press as well as for tilting the press as indicated in FIG. 14 to a proper orientation for the working strokes of the hemming steels as manipulated by the press mechanism.
Figure 16:
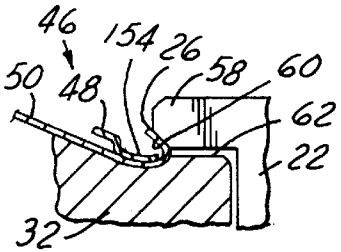
FIGS. 15 and 16 are fragmentary sectional side views of a hemming station anvil supporting a panel assembly and showing a prehemming tool steel respectively in retracted and extended positions, these views being duplicates respectively of FIGS. 5 and 7 of U.S. Pat. No. 5,457,981 and having the same reference numerals as used therein.
Figure 15:
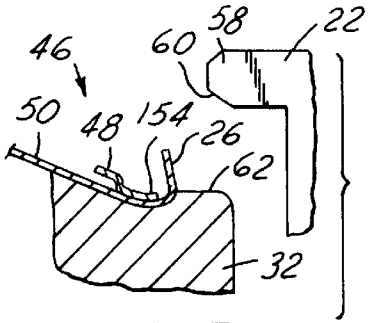
Figure 17:
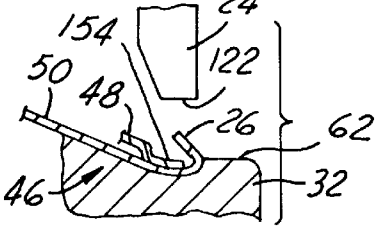
FIGS. 17 and 18 are fragmentary sectional side views duplicating FIGS. 9 and 10 of the '981 patent and employing the reference numerals used therein, FIG. 17 illustrating the final hemming tool steel adjacent the prehemmed edge of the sheet on the anvil, and FIG. 18 illustrating the final hemming tool steel in a final hem position after having formed a return bend in the outer panel sheet and then forced the flange into overlapping flat engagement with the edge of the inner sheet of the panel assembly received on the anvil.
Figure 18:
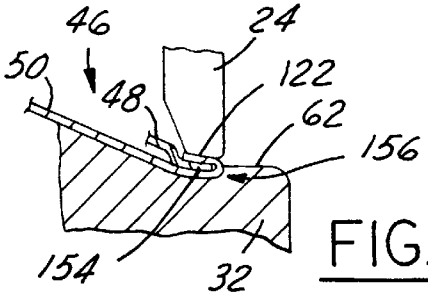

Referring to FIG. 14, in the next step of the method of the invention, and in accordance with another principal feature thereof, a precision vertically movably mounted overhead hold down fixture 360 is provided in the hemming station apparatus. Fixture 360 has two precision locating pins 362 and 364 mounted in a bottom plate 366 carried by the ram 368 of fixture 360. PLP pins 362 and 364 protrude downwardly from plate 366 and are precision located relative to anvil 354. Pins 362 and 364 are tapered in order to facilitate initial insertion registry with PLP holes 220 and 222 respectively of inner panel 226, and then to cam wedge, and thereby shift, inner panel subassembly 226 slightly laterally relative to outer panel 332 as may be necessary in order to precision position inner panel 226 primarily relative to anvil 354 and secondarily relative to outer panel 332. In addition, hold down fixture 360 has two or more suitable hold down clamps 370 and 372 protruding downwardly from plate 366 that are constructed and arranged to duplicate the positioning and hold down force exerted by hold down clamps 252–258 (FIGS. 3B and 5) that are employed in the upstream pierce-after station.

Hence when panel 226 is fully engaged by both the PLP pins 362 and 364 as well as by the hold down clamps 370 and 372 at the final precision adjusted, lowered stop position of fixture 360, inner panel subassembly 226 will be precision located relative to outer panel 332, and more importantly with the interlock holes 314–324 in flange 224 precisely located relative to the hemming fixture anvil 354 of the hemming station and to the associated hemming press machine tooling provided therein. The interlock holes are thus now re-positioned in the hemming fixture at the precise geometric and dimensional locations relative to PLP holes 220 and 222 that these interlock holes assumed as they were formed in the pierce-after station. Thus due to this precise inner panel interlock hole fixture positioning in the hemming station it now becomes not only readily feasible to construct and arrange a plurality of flange staking implements in the final steel tooling of the hemming press machine, but also to insure that the staking implement working strokes are precision pre-aligned with known and precision predetermined interlock hole locations on the press anvil 354. Hence the staking operation (described hereinafter) now can be preformed in a repetitive but precision manner part-to-part to obtain uniform and reliable results as to each of the plurality of ultimate interlock joints conjointly machine constructed in this manner.

As will be evident from the simplified views of FIGS. 13 and 14, due to the curvature of the assembly of the inner and outer panels 226 and 332 as they are clamped on the seating surface 352 of anvil 354, the path of travel 380 (FIG. 13) of the staking implement on its working stroke (illustrated by way of example in the portion of FIG. 13 encompassed by the circle 382) is preferably oriented perpendicular to the planar orientation of the peripheral flange 224 of the inner panel at each such staking location in order to reduce or eliminate bending stresses on the staking punch. Preferably, the path of travel of the working stroke of the stoking punch is parallel to the travel line of action of the hemming steel of the hemming press during final hemming engagement as this is also the preferred mode of operation of the hemming press.

As indicated in simplified form in FIG. 14, as in conventional hemming practice, a pair the hemming gate machines 20 and 20' are precisely positioned at the hemming station to operate concurrently on the panel flanges on opposite side edges of the panel. Thus any tendency of metal working forces exerted by one gate tending to shift the multiply panel assembly 226/332 on anvil 354 parallel to the plane of the drawing is counterbalanced by the simultaneous operation of the opposite gate.

As indicated previously, hemming gate machines 20 and 20' are preferably constructed in accordance with the aforementioned U.S. Pat. No. 5,457,981 and hence are not described in detail herein. As set forth in the '981 patent, for some applications, usually to facilitate insertion and/or removal from, and transfer of, panels through press 20, it is pivotally mounted so it can be tilted by stub shafts fixed to the outer plates 54 and received in a cradle-like base. Such a tilt mounting of machine 20 is shown FIG. 19 wherein the hemming gate machine 20 is mounted for tilting on the cradle like base 21, as hitherto constructed and used commercially in known manner.

Figure 20:
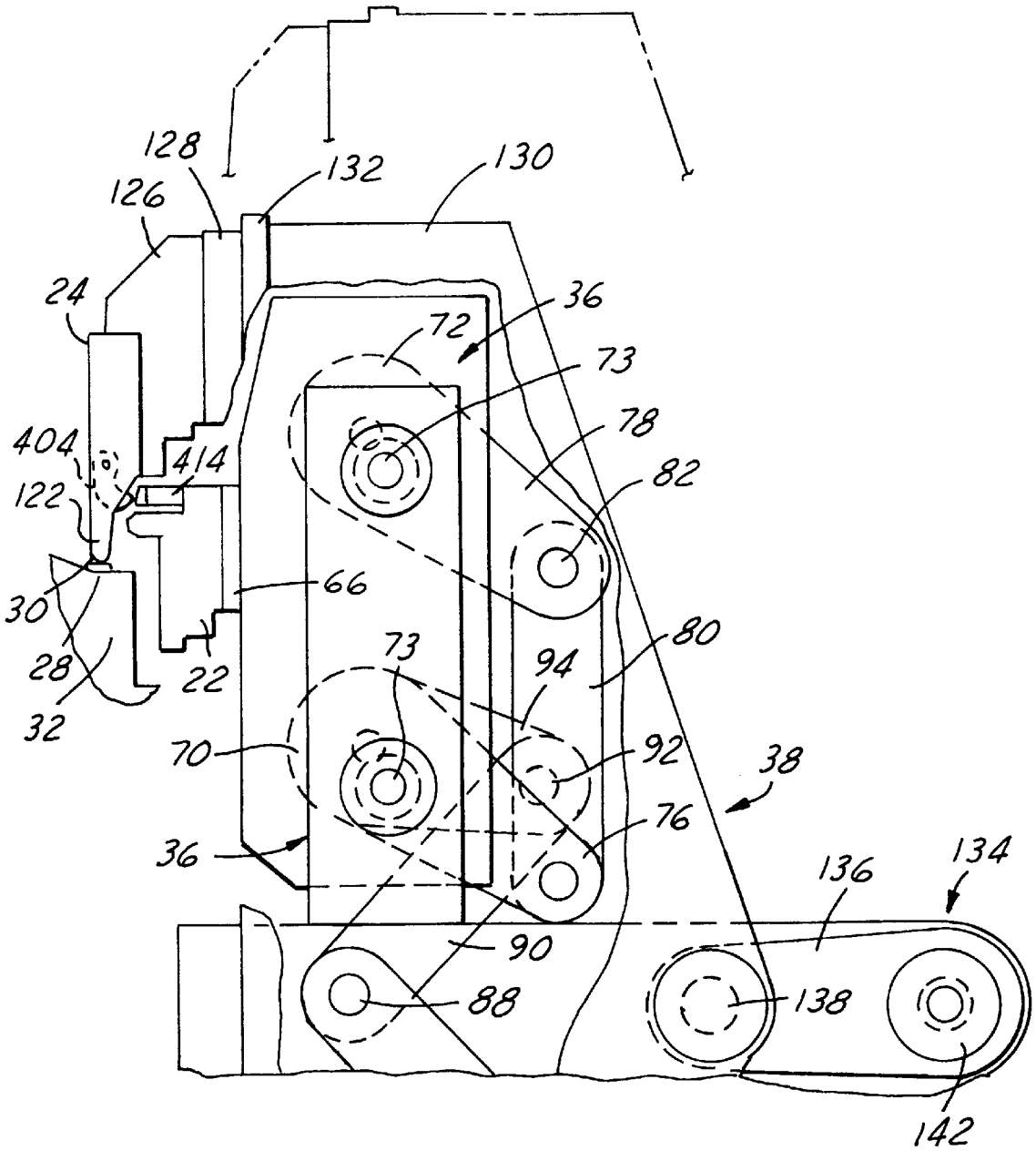
FIG. 20 is a fragmentary semi-diagrammatic side view of the upper portion of the hemming press machine of FIG. 19 as shown and numbered in FIG. 1 of the '981 patent and as described therein, as modified in accordance with the invention to incorporate a stake punch and an associated actuating cam mounted in the final hemming steel and in turn actuated by a pusher carried on the prehemming steel of the machine.

For convenience and brevity, a portion of FIG. 12 of the '981 patent is duplicated in FIG. 20 herein, and the reference numerals utilized in FIG. 12 of the '981 patent are again utilized in FIG. 20 herein to facilitate cross referencing to the description of the structure, function and mode of operation of these elements by reference to the '981 patent. Likewise FIGS. 5 and 7 of the '981 patent are duplicated as FIGS. 15 and 16 herein to illustrate the operation of the prehemming steel 22, and FIGS. 9 and 10 of the '981 patent are duplicated herein as FIGS. 17 and 18 respectively to illustrate the operation of the final hemming steel 24. Again, the reference numerals appearing in FIGS. 15–18 are those employed in the '981 patent, it being understood that hemming station anvil 354 described with reference to FIGS. 13 and 14 corresponds to the hemming station anvil 32 of FIGS. 15–18 as described in the '981 patent.

It is also to be understood that preferably another pair of hemming gate machines corresponding to gates 20 and 20' are provided at the hemming station and also arrayed diametrically opposite one another to operate on the flanges of the panel assembly at the opposite end edges of the same, such end edge pair of hemming gates also operating concurrently with one another to cancel out shift inducing forces during their hemming operation. The end edge flange hem gates operate alternately with the side edge flange gates 20 and 20' to avoid interference therebetween, i.e., opposed pairs of hemming gates are titled back out of the way when the other opposed pair of tiltable gates swing into action, and vice versa.

It is also to be further understood that for purposes of understanding the prehemming and final hemming operations performed by the aforementioned hemming gate machines 20 and 20' in practicing the method of the present invention, the inner and outer panels referenced at 48 and 50 in FIGS. 15–18 correspond to inner and outer panels 226 and 332 described herein above. Likewise the underlying edge 154 of the reinforcing inner panel 48 in the '981 patent corresponds to the peripheral flange 224 of inner panel 226 described hereinabove, and the upright flange 26 of outer panel 50 corresponds to the flange 334 of outer panel 332 as described hereinabove.

In accordance with a further feature of both the improved method and improved apparatus of the present invention, the improved interlock joint formed at each of the interlock flange holes 314–322, etc. is accomplished by operation of a staking or coining tool suitably mounted and precision located in the associated final hemming steel 24. A preferred embodiment of a hemming gate 20 as so modified to incorporate a staking tool for performing the method of the invention is shown in simplified form in FIGS. 20, 21 and 22. An alternate embodiment of a staking tool mounted in the final hemming steel is shown in simplified form in FIGS. 23, 24, 25 and 26.

Figure 21:
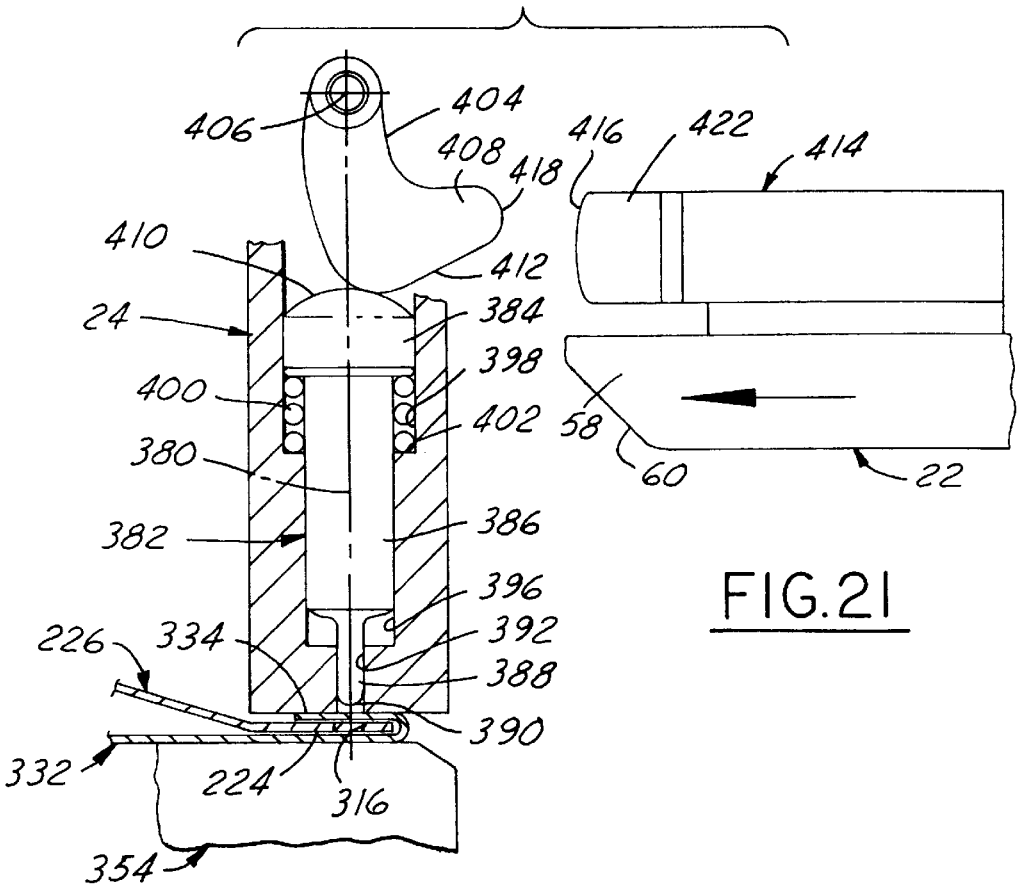
FIGS. 21 and 22 are semi-diagrammatic fragmentary views illustrating the sequential operation of the stake punch mechanism of FIG. 20 as cam actuated on its working stroke within the final hemming steel and engaged by the pusher carried by the prehemming steel during a portion of its motion in the cycling of the machine shown in FIG. 20.
Figure 22:
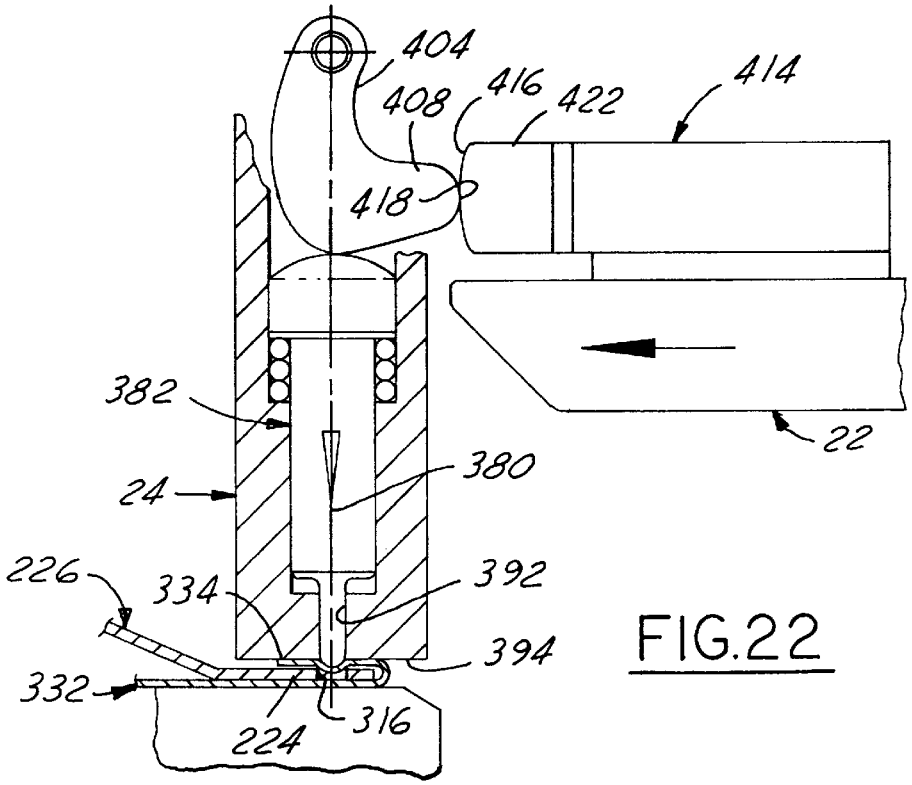

Referring to FIGS. 20–22, the final hemming steel 24 of the combined pre-hemming and final hemming press 20 is provided with a plurality of interlock staking tool subassemblies, one at each interlock hole location in the associated inner panel flange 224 being hemmed by that steel. Each staking tool subassembly includes a staking or coining punch tool 382 slidably mounted in final steel 24 for reciprocation on a working and retraction strokes with its path of stroke travel coincident with the line of action 380 of steel 24. Tool 382 comprises a cylindrical head 384, a cylindrical shank 386 and a reduced diameter cylindrical staking tip 388 terminating in a hemispherical metal working nose 390 at its lower end. The tool tip 388 slides in a cylindrical bore 392 opening at its lower end to the lower face 394 of steel 24 and opening at its upper end to a counterbore 396 that slidably receives shank 386. Counterbore 386 opens its upper end to a larger diameter second counterbore 398 in which head 384 is slidably guided. A coil compression spring 400 bottoms on a shoulder 402 at the junction of counterbores 396 and 398 and its upper end against the underside of head 384.

The staking tool subassembly also includes an actuating cam 404 pivotally mounted on a bearing pin 406 in turn journal mounted in tool steel 24, it being understood that the mounting cavity formed in steel 24 to accommodate cam 404 opens at the rear face of the steel to enable a toe portion 408 of cam 404 to protrude therefrom in both the retracted position of tool 382 shown in FIG. 21 and in the fully extended position of tool 382 shown in FIG. 22. The upper surface 410 of tool head 384 and the undersurface 412 of cam 404 are suitably contoured as shown in FIGS. 21 and 22 so that when cam 404 is forced to pivot clockwise (as viewed in FIGS. 21 and 22) from the position of FIG. 21 to the that of FIG. 22, cam surface 412 operates with a force multiplying action to cam drive tool 382 through its working stroke. The force for actuating cam 404 to drive tool 382 through its working stroke is applied by an axially adjustable pusher 414 fixably attached to the prehemming steel 22 for travel therewith.

The operation of stake punch 382 is thus under the control of, and is driven by, the main driving forces and drive mechanism operating both the prehemming steel 22 and the final hemming steel 24 of machine 20 through their pre-existing respective sequential cycles of motion. Thus when the final hemming steel 24 has reached the end of its working stroke as shown in FIG. 21 and is in a dwell portion of its motion cycle, having pressed flange lip 334 flat down against the upper surface of inner panel flange 224 as shown in FIG. 22, punch tip 388 is initially in its retracted position shown in FIG. 21. At this point in the machine cycle the prehemming tool 22 is traveling horizontally toward steel 24 as it returns to its fully retracted dwell position of its own gate motion cycle (shown in FIG. 22). During the working stroke of final steel 24 traveling downwardly to the position shown in FIG. 21, spring 400 has biased punch head 384 upwardly so that cam 404 has been reversibly driven, via head surface 410, to its fully retracted position shown in FIG. 21. The counterclockwise pivotal motion of cam 404 to this retracted end limit position shown in FIG. 21 is stopped by a suitable ledge surface (not shown) in the rear face opening of steel 24 through which cam toe 408 protrudes.

Figure 27:
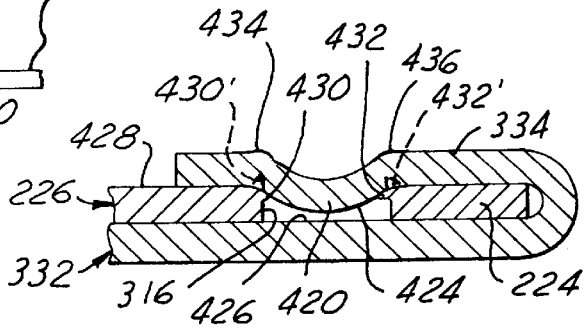
FIG. 27 is a fragmentary cross sectional view enlarged over that of FIG. 26 and illustrating the improved hemming interlock joint construction of the invention as produced in accordance with the method and apparatus of the invention.

As final hemming steel 24 remains or dwells in its working stroke end limit dwell position of FIGS. 21 and 22, pusher 414 is being carried by prehemming steel 22 from its FIG. 21 leftward (as viewed therein) to its FIG. 22 position, thereby bringing the nose surface 416 of an adjustable head 422 of pusher 414 into pushing and sliding abutment with the nose surface 418 of cam toe 408. Such end-of-cycle motion of pre-hemming steel 22 thus causes pusher 414 to rock cam 404 clockwise from the position of FIG. 21 to that of FIG. 22 to thereby drive stake punch 382 through its working stroke. Such punch motion forces nose 390 of punch tip 388 to smoothly strike the upper surface of the flattened flange lip 334, and then to cold work the metal of the flange lip 334 downwardly with a coining action into the registering interlock 316 opening. This punch action forms the complemental hemispherical upset locking portion 420 of flange 334, as best seen in FIG. 27. Pre-hemming steel 22 comes to rest in a dwell phase as shown in FIG. 22, which corresponds to the end limit of the downstroke of stake punch 382. Preferably head 422 of pusher 414 is suitably mounted for fine screw threaded adjustment on the main body of pusher 414 for suitably adjusting the end limit pivotal position of cam 404 to thereby set the protrusion distance of punch nose 390 the desired precise amount beyond the working face 394 of final steel 24.

When pre-hemming steel 22 has come to rest in its dwell position of FIG. 22, and the staking operation has thus been completed, final steel 24 is retracted vertically upwardly by the cycle motion of machine 20 so that toe 408 of cam 404 is carried upwardly and clear of pusher head 422. As this occurs, spring 400 forces punch 382 upwardly on its retraction stroke (from the position of FIG. 22 to the position FIG. 21) relative to steel 24 so that staking nose 390 is withdrawn into the steel and thus recessed from the steel working face 394, as shown in FIG. 21.

Improved Interlock Joint

As best seen in FIG. 27, an improved interlock joint of the invention is thereby formed between the inner and outer panels 226 and 332 by the cold worked flange lip portion 420 being coined downwardly into the interlock opening 316 a predetermined precise distance, but without introducing contact of the undersurface 424 of conical portion 420 with upper surface 426 of outer panel 332. In accordance with an important feature of the present invention, it will be seen from FIG. 27 that the burrs (indicated by broken lines at 430' and 432' in FIG. 27) or other form of upset metal that protrude upwardly from the inboard, upper surface 428 of the border 224 of inner panel 226, that were cold work formed during the upward, inboard-directed punching action of the pierce units 272–282 during their piercing of border 224 in the aforementioned pierce-after station of FIGS. 3B–9, are now, via lip 334, swedged downwardly to form the coined-in barbs 430 and 432 that bite into coined portion 420 of the hemmed flange lip 334 of the outer panel 332. Such barbs 430', 432' may thus be the typical discrete and random residual punching barbs from the upward piercing stroke of the pierce units, or such may only be in the front of a continuous or interrupted circular ridge of upwardly deformed metal bordering the punch hole 316. In either event these work hardened, upwardly upset metal portions 430', 432' now become the flattened down barbs 430 and 432 that are imbedded and mechanically engaged into the coined lip portion 420 to thereby mechanically augment the strength of the interlock joint.

Additional Advantages and Improved Results

In accordance another feature of the present invention it will be seen that the precise positioning of inner panel border area 224 in the hemming fixture locates the interlock holes 314–324 formed in the pierce-after station in precise coaxial alignment with the axis 380 of the work stroke of each associated staking punch 382. Hence the concentricity and resultant maximization of interlocking strength of the final formed elements 420 and 316 of the interlock joint is assured in the final product on a reliable part-to-part basis even in a high speed mass production set up wherein the joints are formed automatically by the hemming machine motions. Since the interlock joints are formed as a final phase of the final hemming steel action, such joint formation is accomplished very economically with only a minor increase in hemming machine cycle time and requires only a relatively inexpensive modification to the preexisting final hemming machine components.

Moreover, these improved results are obtained while at the same time solving the read through problem. The deformation of the outer panel metal caused by the pierce barbs 430', 432' now appears, if at all, as deformations 434 and 436 (FIG. 27) that protrude in an inboard direction from the inboard surface of the hemmed flange lip 334 of outer panel 332, instead of appearing as deformations in the outboard surface of outer panel 332 as in the prior art. In addition, it will be seen that the compound or total thickness of the interlock joint is not increased in overall dimension over that contributed by (1) the thickness of the sheet metal of outer panel 332, (2) that of the border 224 of inner panel 226 and (3) the hemmed flange lip 334, which is only 75% or less of the total thickness of the raised bead type interlock joint as produced in the aforementioned prior art U.S. Pat. No. 5,237,734. Also, the resultant essentially smooth surface remaining on the inboard side of flange lip 334 after formation of the interlock joints facilitates mounting of various add-on materials and components to the door assembly as may be required in a variety of automotive body applications. Due to the strength and precision of the improved interlock joints produced in accordance with the invention, in many applications the need for supplemental joint strengthening procedures and materials, such as welding, adhesive or the like is substantially reduced if not altogether eliminated.

Modified Steel-Mounted Staking Mechanism

Figure 23:
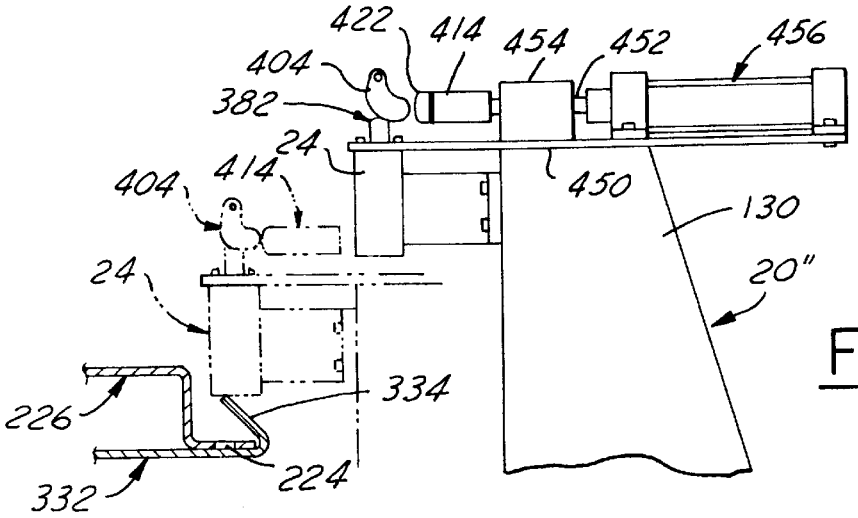
FIGS. 23, 24, 25 and 26 are fragmentary semi-schematic side elevational views of an alternate embodiment of a stake punch mounted in the final hemming steel and actuated by a pneumatic cylinder mounted on the upper end of the frame 130 shown in FIG. 20, and illustrating sequentially the motion of the final hemming steel as it forces the prehem flange down against the flange of the inner panel, followed by actuation of the stake punch to coin a portion of the bent over flange of the outer panel into the interlock hole of the flange of the inner panel.
Figure 24:
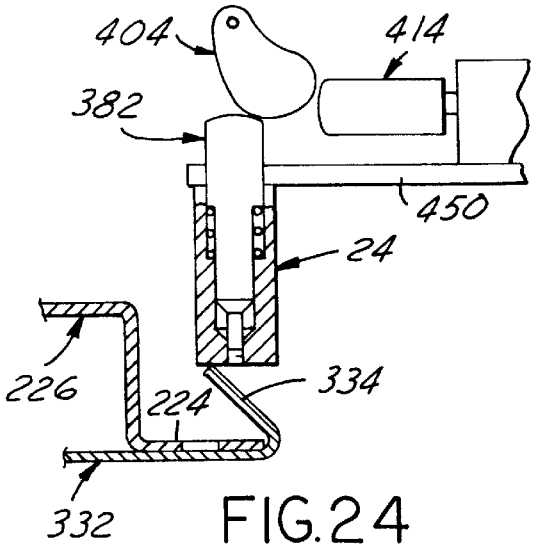
Figure 25:
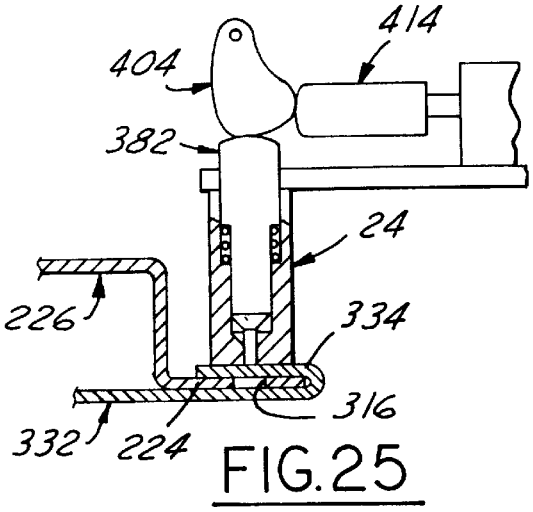
Figure 26:
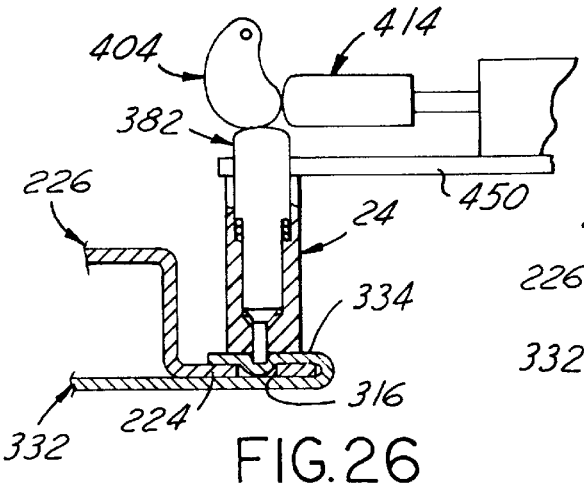

FIGS. 23–26 illustrate an alternate embodiment of a stake-punch modification of the final hemming steel 24. In this embodiment the stake punches 382 are mounted in steel 24 so as to protrude through and above a frame plate 450 mounted to the upper end of frame member 130 and also to the upper end of steel 24. Cams 404 associated with each stake punch 382 are mounted by suitable super structure (not shown) mounted on and carried by frame plate 450. However, instead of being operated by pushers mounted on the prehemming steel as in the prior embodiment, cams 404 are independently actuated by suitable cam drive units mounted on frame plate 450. As shown in FIG. 23 the cam drive unit may consist of a pusher 414 mounted on the end of a piston rod 452 carried by a journal block 454 in turn mounted on frame plate 450. Piston rod 452 is part of a conventional fluid operated power cylinder unit 456 likewise mounted on frame plate 450. Unit 456 may be a pneumatic or hydraulic ram unit operated by conventional fluid supply and control systems coordinated with the control systems for the hemming gate 20" as so modified.

As will be seen from the sequence of motions successively illustrated in FIGS. 23, 24, 25 and 26, the operation of drive unit 456 is coordinated to produce the staking operation by punch 382 in the same sequence as that described previously in connection with the embodiment of FIGS. 20–22. It will be understood that the embodiment of FIGS. 23–26 is useful when modifying a hemming gate that is made without a combination of the prehemming and final hemming steels, and hence is advantageous when retrofitting the various types of separate hemming gates of the prior art that are still in commercial use and were in such use prior to the '981 patent.

From the foregoing description it will now be apparent to those skilled in the art that the improved method, apparatus and interlock joint of the invention amply achieve and fulfill the aforestated objects and provide many features and advantages over the prior art as set forth previously hereinabove, both expressly as well as implicitly as now will be readily recognized by those as skilled in the art. It also will be understood that further variations and modifications of the method, apparatus and joint of the invention now will become apparent to those skilled in the art from the foregoing disclosure without departing from the spirit and scope of the invention. For example, in some applications the stake punches 382 can be eliminated in favor of a simple coining dimple provided integrally on the working face 394 of the final steel 24, and such stake coining dimple configured to cooperate with the geometry of the punched interlock hole in the inner panel. Also, although less desirable and more expensive, the joint staking-coining operation could be performed by a separate punching apparatus mounted at the hemming station and fixtured for precision alignment with fixtured interlock holes and adapted to cycle into operation when the hemming gates are swung out to their retracted, fixture-clearing positions in their cycle of operation after the final hemming operation has been completed by such hemming gates.

I claim:

1. A method of interlocking hemmed together edges of inner and outer vehicle body panels wherein the outer panel is formed to a pre-finished condition with a hemming edge border flange lip bent up from a peripheral margin of the main vehicle-interior-facing (inboard) surface of the outer panel, comprising the steps of:

(1) stamping the inner panel to a desired size and shape including forming generally flat peripheral border and a main central portion offset inboard from the border in vehicle mounted use, (2) trimming the border of the pre-stamped inner panel to desired outside dimensions, (3) forming an inner panel and hardware sub-assembly by attaching a plurality of hardware components by welding to the inner panel, (4) then forming a plurality of interlock holes in the inner panel border by individually piercing out the holes in the border with a piercing tool moving through the border from the outboard side to the inboard side of the border while the inner panel is held and located in a predetermined orientation relative to piercing tool travel, (5) marrying the inner panel to the outer panel by placing the outer panel outboard side down on a locating fixture and placing the inner panel outboard side down on the inboard side of the outer panel with the outer edge of the inner panel border disposed inwardly adjacent the raised hemming flange lip of the outer panel and then crimping partially inwardly a plurality of spaced portions of the outer panel flange lip to hold the two panels temporarily assembled, and (6) then hemming the flange lip of the outer panel over the inboard surface of the border of the inner panel by hemming steel means and permanently interlocking the panels by providing staking means located to register a staking tool individually with the interlock holes and operable to deform the registered portion of the hemmed flange lip into the associated interlock hole in the inner panel border.

2. The method of claim 1 including the further steps of:

(7) providing at least two principal locating point (PLP) openings in the inner panel prior to step (4), (8) then locating the inner panel in step (4) by locating pin means registered in the PLP openings to thereby precisely position the interlock holes as formed relative to the PLP openings, and (9) subsequently locating the married panels in a hemming anvil fixture for performing step (6) by locating pin means registered in the PLP openings to thereby precisely position each interlock hole for precision registry with the travel path of the working stroke of an associated staking tool of the staking means such that the deformed portion of the outer panel hemmed flange lip is centered on the associated interlock hole.

3. The method of claim 1 wherein the hemming and staking operations of step (6) are performed by a flanging press machine carrying a final hemming steel member operable to perform the final hemming of the outer panel flange lip flat against the inner panel border, and providing the staking means mounted on and carried by the final hemming steel member.

4. The method of claim 3 including the further step of providing the flanging press machine with stake drive means for reciprocating the staking tool of the staking means through its working stroke in timed relation with the completion of the final hemming operation and while the final hemming steel member is being pressed against the hemmed lip in its finished fully hemmed orientation relative to the inner panel border.

5. The method of claim 4 including the further step of providing the flanging press machine as a combined prehemming and final hemming type machine also carrying a pre-hemming steel operable to push the outer panel flange lip from its upstanding position to an angled position overhanging the inner panel border and then to retract clear of the panels during subsequent motion of the final hemming steel through its operation cycle, and also providing the stake drive means mounted on the pre-hemming steel for operably driving the associated staking tool within the final hemming steel when the latter is fully extended on its working stroke and the pre-hemming steel is moving in its operation cycle motion.

6. The method of claim 2 wherein the hemming and staking operations of step (6) are performed by a flanging press machine carrying a final hemming steel member operable to perform the final hemming of the outer panel flange lip flat against the inner panel border, and providing the staking means mounted on and carried by the final hemming steel member.

7. The method of claim 6 including the further step of providing the flanging press machine with stake drive means for reciprocating the staking tool of the staking means through its working stroke in timed relation with the completion of the final hemming operation and while the final hemming steel member is being pressed against the hemmed lip in its finished fully hemmed orientation relative to the inner panel border.

8. The method of claim 7 including the further step of providing the flanging press machine as a combined prehemming and final hemming type machine also carrying a pre-hemming steel operable to push the outer panel flange lip from its upstanding position to an angled position overhanging the inner panel border and then to retract clear of the panels during subsequent motion of the final hemming steel through its operation cycle, and also providing the stake drive means mounted on the pre-hemming steel for operably driving the associated staking tool within the final hemming steel when the latter is fully extended on its working stroke and the pre-hemming steel is moving in its operation cycle motion.

9. A method of interlocking hemmed together edges of inner and outer panels and preventing distortion of the outer panel, comprising the steps of:

forming a plurality of interlock holes at spaced intervals along the edge of only the inner panel with raised hole marginal portions on the inboard side of the inner panel;

placing the outer panel on a complementary platen;

placing the inner panel inside the outer panel with the raised portions facing away from the outer panel; and hemming the edge of the outer panel over the edge of the inner panel by hemming punch means having a plurality of staking tools therein located to register with the holes of the inner panel so that the edge of the outer panel is cold worked to form deformed portions protruding individually into interlocking engagement into and with the holes of the inner panel and deforms the associated raised hole marginal portion on the inner panel to thereby interlock the inner and outer panels together against relative movement.

10. The method of claim 9 further characterized by the deformed portions being spaced out of contact with the inboard surface of the outer panel underlying the edge of the inner panel.

11. The method of claim 10 further characterized by at least one of the interlock holes being elongated to provide an elongated shape extending in a direction parallel with edge of the panel.

12. The method of claim 11 further characterized by at least another one of the interlock holes being elongated in shape with the elongation extending in a direction perpendicular to the edge of the panel.

13. The method of claim 9 further characterized by only a portion of the edge of the outer panel being hemmed over the interlock holes of the inner panel.

14. The method of claim 9 further characterized by the hemming being performed by a hemming die having staking tools and each of the staking tools in the hemming die having a working travel path centered on the associated hole of the inner panel.

15. A method of interlocking hemmed together edges of inner and outer panels and preventing distortion of the outer panel, comprising the steps of:

stamping the inner panel to a desired size and shape including forming a plurality of interlock holes at spaced intervals along the edge of the inner panel by piercing out the holes from the outboard toward the inboard surface of the inner panel, stamping the outer panel to a desired size and shape with the outer panel having a flange forming edge portion adapted to be hemmed over the edge of the inner panel to hem flange the panels together;

placing the outer panel on a complementary platen;

marrying the inner and outer panels by placing the inner panel inside the outer panel with the inboard surface of the inner panel facing away from the outer panel and with fixtures which hold the panels against movement relative one another; and hemming the edge of the outer panel over the edge of the inner panel by hemming punch means having a plurality of staking tools therein located to register with the interlock holes of the inner panel so that the edge of the outer panel is cold worked into interlocking engagement with the holes of the inner panel and forms a depressed bead on the outer panel flange which overlies and closely fits into the associated hole of the inner panel to thereby interlock the inner and outer panels together against relative movement.

* * * * *